US009953557B2

(12) United States Patent
Yata et al.

(10) Patent No.: US 9,953,557 B2
(45) Date of Patent: Apr. 24, 2018

(54) DISPLAY DEVICE

(71) Applicant: Japan Display Inc., Tokyo (JP)

(72) Inventors: Tatsuya Yata, Tokyo (JP); Takayuki Nakanishi, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 15/194,918

(22) Filed: Jun. 28, 2016

(65) Prior Publication Data

US 2017/0004757 A1 Jan. 5, 2017

(30) Foreign Application Priority Data

Jul. 2, 2015 (JP) ..... 2015-133938

(51) Int. Cl.

| | |
|---|---|
| ***G09G 5/02*** | (2006.01) |
| ***G09G 3/20*** | (2006.01) |
| ***G09G 3/3291*** | (2016.01) |
| ***G09G 3/3233*** | (2016.01) |
| *G09G 3/36* | (2006.01) |

(52) U.S. Cl.

CPC ..... *G09G 3/2003* (2013.01); *G09G 3/3233* (2013.01); *G09G 3/3291* (2013.01); *G09G 3/3607* (2013.01); *G09G 3/3688* (2013.01); *G09G 2300/0452* (2013.01); *G09G 2300/0842* (2013.01); *G09G 2340/0457* (2013.01); *G09G 2340/06* (2013.01)

(58) Field of Classification Search

None

See application file for complete search history.

(56) References Cited

U.S. PATENT DOCUMENTS

| | | | | |
|---|---|---|---|---|
| 2004/0174389 | A1 | 9/2004 | Ben-David et al. | |
| 2006/0098033 | A1* | 5/2006 | Langendijk | G02B 5/201 345/694 |
| 2010/0188437 | A1 | 7/2010 | Itoh et al. | |
| 2010/0265283 | A1 | 10/2010 | Langendijk et al. | |
| 2015/0213748 | A1* | 7/2015 | Park | G09G 3/2003 345/55 |

FOREIGN PATENT DOCUMENTS

| | | | |
|---|---|---|---|
| JP | 2007-128097 | A | 5/2007 |
| JP | 2011-504603 | A | 2/2011 |
| WO | 2008/153003 | A | 12/2008 |

* cited by examiner

*Primary Examiner* — Ifedayo Iluyomade
(74) *Attorney, Agent, or Firm* — Michael Best & Friedrich LLP

(57) ABSTRACT

According to an aspect, a display device includes a plurality of pixels arranged along a row direction and a column direction. One pixel includes a set of sub-pixels including two sub-pixels that correspond to two colors complementary to each other and are arranged adjacent to each other along one of the row direction and the column direction, and two or more combinations of sub-pixels for outputting white light by combining adjacent sub-pixels are present for one sub-pixel.

7 Claims, 20 Drawing Sheets

DISPLAY DEVICE

CROSS-REFERENCE TO RELATED APPLICATIONS

This application claims priority from Japanese Application No. 2015-133938, filed on Jul. 2, 2015, the contents of which are incorporated by reference herein in its entirety.

BACKGROUND

1. Technical Field

The present invention relates to a display device.

2. Description of the Related Art

Known are display devices in which one pixel includes sub-pixels of red (R), green (G), blue (B), cyan (C), magenta (M), and yellow (Y) (for example, WO 2008/153003).

However, in the display devices in which one pixel includes sub-pixels of red (R), green (G), blue (B), cyan (C), magenta (M), and yellow (Y) in the related art, resolution in units of a pixel cannot be higher than one sixth of the number of sub-pixels.

For the foregoing reasons, there is a need for a display device that can perform display output with higher resolution. Alternatively, there is a need for a display device having more various combinations of sub-pixels for reproducing contrast of white light.

SUMMARY

According to an aspect, a display device includes a plurality of pixels arranged along a row direction and a column direction. One pixel includes a set of sub-pixels including two sub-pixels that correspond to two colors complementary to each other. The two sub-pixels are arranged adjacent to each other along one of the row direction and the column direction. Two or more combinations of sub-pixels for outputting white light by combining adjacent sub-pixels are present for one sub-pixel.

DETAILED DESCRIPTION

Figure 1:
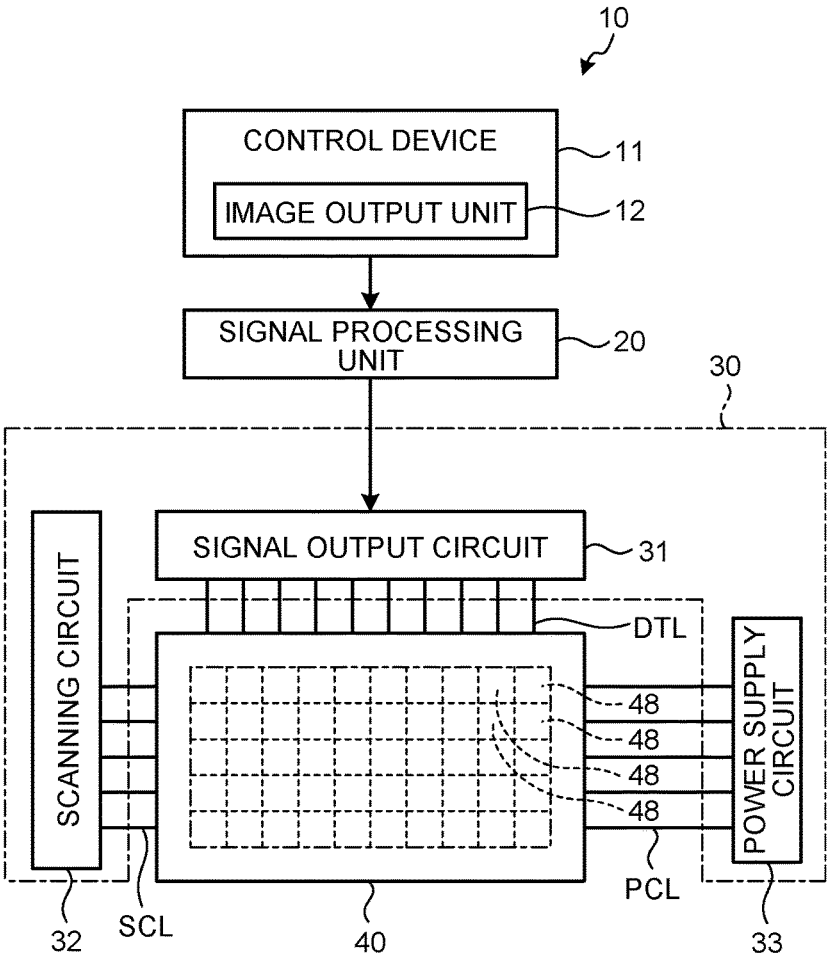
FIG. 1 is a block diagram illustrating an example of a configuration of a display device according to a first embodiment of the present invention.

The following describes embodiments of the present invention with reference to the accompanying drawings. The disclosure is merely an example, and the present invention naturally encompasses appropriate modifications maintaining the gist of the present invention that is easily conceivable by those skilled in the art. To further clarify the description, the width, the thickness, the shape, and the like of each component may be schematically illustrated in the drawings as compared with an actual aspect. However, this is merely an example and interpretation of the present invention is not limited thereto. The same elements as those described in the drawings that have already been discussed are denoted by the same reference numerals through the description and the drawings, and detailed descriptions thereof will not be repeated in some cases.

FIG. 1 is a block diagram illustrating an example of a configuration of a display device 10 according to a first embodiment of the present invention. As illustrated in FIG. 1, the display device 10 according to the first embodiment includes a signal processing unit 20, an image-display-panel driving unit 30, and an image display panel 40. The signal processing unit 20 is a circuit that receives an input signal (RGB data) from an image output unit 12 of a control device 11, generates a signal by performing predetermined data conversion processing on the input signal, and transmits the resultant signal to components of the display device 10. The image-display-panel driving unit 30 is a circuit that controls the driving of the image display panel 40 based on the signal from the signal processing unit 20. The image display panel 40 is an image display panel that displays an image by causing a self-luminous body of a pixel to be lit based on the signal from the image-display-panel driving unit 30.

Figure 2:
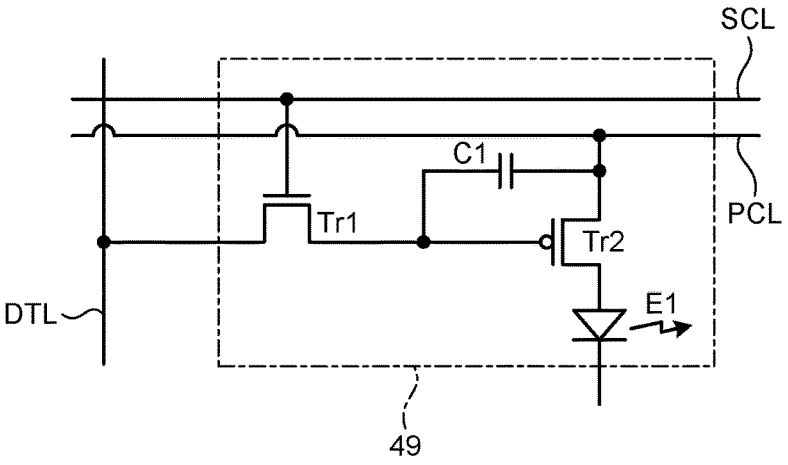
FIG. 2 is a diagram illustrating a lighting drive circuit of a sub-pixel included in a pixel of an image display panel according to the first embodiment.
Figure 3:
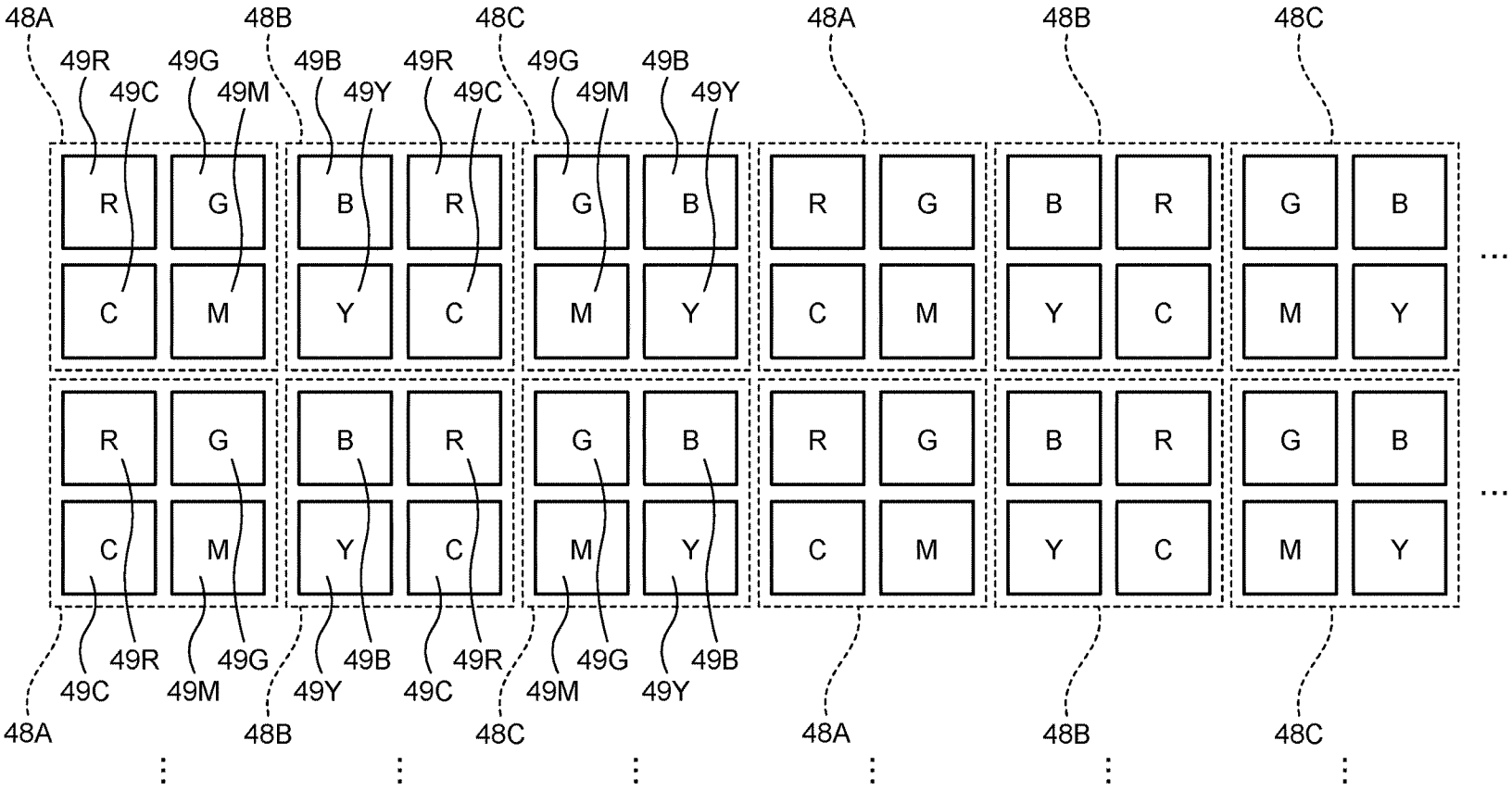
FIG. 3 is a diagram illustrating an array of sub-pixels of the image display panel according to the first embodiment.
Figure 4:
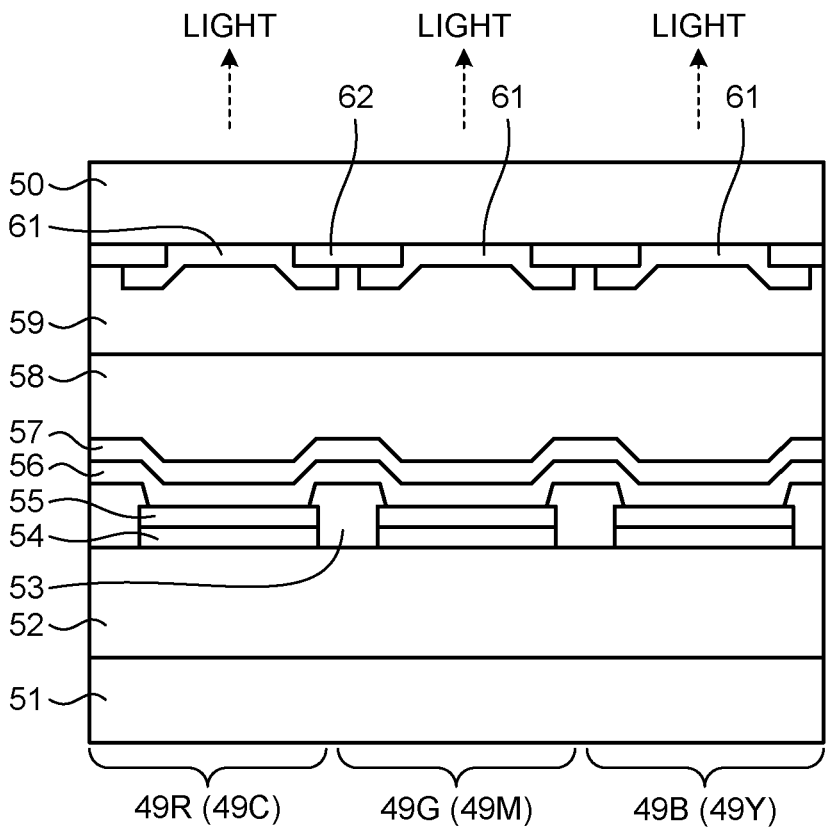
FIG. 4 is a diagram illustrating a cross-sectional structure of the image display panel according to the first embodiment.

First, the following describes a configuration of the image display panel 40. FIG. 2 is a diagram illustrating a lighting drive circuit of a sub-pixel included in the pixel of the image display panel according to the first embodiment. FIG. 3 is a diagram illustrating an array of sub-pixels of the image display panel according to the first embodiment. FIG. 4 is a diagram illustrating a cross-sectional structure of the image display panel according to the first embodiment. As illustrated in FIG. 1, in the image display panel 40, $P_0 \times Q_0$ pixels 48 ($P_0$ in a row direction, and $Q_0$ in a column direction) are arranged in a two-dimensional matrix (rows and columns). That is, in the display device 10 according to the present embodiment, a plurality of pixels 48 are arranged along the row direction and the column direction.

The pixel 48 includes a plurality of sub-pixels 49, and the lighting drive circuits of the sub-pixels 49 illustrated in FIG. 2 are arranged in a two-dimensional matrix (rows and columns). As illustrated in FIG. 2, each lighting drive circuit includes a control transistor Tr1, a driving transistor Tr2, and a charge holding capacitor C1. A gate of the control transistor Tr1 is coupled to a scanning line SCL, a source thereof is coupled to a signal line DTL, and a drain thereof is coupled to a gate of the driving transistor Tr2. One end of the charge holding capacitor C1 is coupled to the gate of the driving transistor Tr2, and the other end thereof is coupled to a source of the driving transistor Tr2. The source of the driving transistor Tr2 is coupled to a power supply line PCL, and a drain of the driving transistor Tr2 is coupled to an anode of an organic light emitting diode E1 serving as a self-luminous body. A cathode of the organic light emitting diode E1 is coupled, for example, to a reference potential (for example, a ground). FIG. 2 illustrates an example in which the control transistor Tr1 is an n-channel transistor and the driving transistor Tr2 is a p-channel transistor. However, a polarity of each transistor is not limited thereto. The polarity of each of the control transistor Tr1 and the driving transistor Tr2 may be determined as needed.

As illustrated in FIG. 3 for example, each pixel 48 of the image display panel 40 includes four sub-pixels 49. Specifically, one pixel 48 includes sub-pixels of four colors out of sub-pixels 49 of six colors including a first sub-pixel 49R, a second sub-pixel 49G, a third sub-pixel 49B, a fourth sub-pixel 49C, a fifth sub-pixel 49M, and a sixth sub-pixel 49Y. The first sub-pixel 49R, the second sub-pixel 49G, and the third sub-pixel 49B emit light in a first primary color, a second primary color, and a third primary color, respectively, in a display output performed by the image display panel 40. The fourth sub-pixel 49C, the fifth sub-pixel 49M, and the sixth sub-pixel 49Y emit light in a complementary color of the first primary color, a complementary color of the second primary color, and a complementary color of the third primary color, respectively, in a display output performed by the image display panel 40. Although the present embodiment describes a case in which the first primary color, the second primary color, and the third primary color are red (R), green (G), and blue (B), any color can be freely selected as each of the first primary color, the second primary color, and the third primary color. In the present embodiment in which the first primary color, the second primary color, and the third primary color are red (R), green (G), and blue (B), respectively, the complementary color of the first primary color, the complementary color of the second primary color, and the complementary color of the third primary color are cyan (C), magenta (M), and yellow (Y), respectively. These complementary colors are determined depending on the primary colors. In the description of the present embodiment in which the first sub-pixel 49R, the second sub-pixel 49G, the third sub-pixel 49B, the fourth sub-pixel 49C, the fifth sub-pixel 49M, and the sixth sub-pixel 49Y are not required to be distinguished from each other, or which can be applied to all of them, each of them may be simply described as the sub-pixel 49.

As illustrated in FIG. 4, the image display panel 40 includes a substrate 51, insulating layers 52 and 53, a reflective layer 54, a lower electrode 55, a self-luminous layer 56, an upper electrode 57, an insulating layer 58, an insulating layer 59, a color filter 61 serving as a color conversion layer, a black matrix 62 serving as a light shielding layer, and a substrate 50. The substrate 51 is a semiconductor substrate made of silicon and the like, a glass substrate, a resin substrate, and the like, and forms or holds the lighting drive circuits and other elements. The insulating layer 52 is a protective film that protects the lighting drive circuits and other elements, and may be made of silicon oxide, silicon nitride, and the like. The lower electrode 55 is provided to each of the first sub-pixel 49R, the second sub-pixel 49G, the third sub-pixel 49B, the fourth sub-pixel 49C, the fifth sub-pixel 49M, and the sixth sub-pixel 49Y, and is an electric conductor serving as an anode (positive pole) of the organic light emitting diode E1 described above. The lower electrode 55 is a translucent electrode made of a translucent conductive material (translucent conductive oxide) such as indium tin oxide (ITO). The insulating layer 53 is an insulating layer that is called a bank and partitions the first sub-pixel 49R, the second sub-pixel 49G, the third sub-pixel 49B, the fourth sub-pixel 49C, the fifth sub-pixel 49M, and the sixth sub-pixel 49Y from each other. The reflective layer 54 is made of a material having metallic luster such as silver, aluminum, and gold, which reflects light from the self-luminous layer 56. The self-luminous layer 56 includes an organic material and includes a hole injection layer, a hole transport layer, a light emitting layer, an electron transport layer, and an electron injection layer (not illustrated).

As a layer that generates positive holes, for example, it is preferable to use a layer including an aromatic amine compound and a substance exhibiting an electron accepting property to the compound. The aromatic amine compound is a substance having an arylamine skeleton. Among aromatic amine compounds, especially preferred is an aromatic amine compound including triphenylamine in the skeleton thereof and having a molecular weight of 400 or more. Among aromatic amine compounds including triphenylamine in the skeleton thereof, especially preferred is an aromatic amine compound including a condensed aromatic ring such as a naphthyl group in the skeleton thereof. When the aromatic amine compound including triphenylamine and a condensed aromatic ring in the skeleton thereof is used, heat resistance of a light emitting element is improved. Specific examples of the aromatic amine compound include, but are not limited to, 4,4'-bis [N-(1-naphthyl)-N-phenylamino] biphenyl (abbreviated as α-NPD), 4,4'-bis [N-(3-methylphenyl)-N-phenylamino] biphenyl (abbreviated as TPD), 4,4',4"-tris (N,N-diphenylamino) triphenylamine (abbreviated as TDATA), 4,4',4"-tris [N-(3-methylphenyl)-N-phenylamino] triphenylamine (abbreviated as MTDATA), 4,4'-bis [N-{4-(N,N-di-m-tolylamino) phenyl}-N-phenylamino] biphenyl (abbreviated as DNTPD), 1,3,5-tris [N,N-di(m-tolyl) amino] benzene (abbreviated as m-MTDAB), 4,4',4"-tris (N-carbazolyl) triphenylamine (abbreviated as TCTA), 2,3-bis (4-diphenylaminophenyl) quinoxaline (abbreviated as TPAQn), 2,2',3,3'-tetrakis (4-diphenylaminophenyl)-6,6'-bisquinoxaline (abbreviated as D-TriPhAQn), 2,3-bis {4-[N-(1-naphthyl)-N-phenylamino] phenyl}-dibenzo [f,h] quinoxaline (abbreviated as NPADiBzQn), etc. The substance exhibiting the electron accepting property to the aromatic amine compound is not specifically limited. For example, molybdenum oxide, vanadium oxide, 7,7,8,8-tetracyanoquinodimethane (abbreviated as TCNQ), and 2,3,5,6-tetrafluoro-7,7,8,8-tetracyanoquinodimethane (abbreviated as F4-TCNQ) can be used as the substance.

An electron transport substance is not specifically limited. For example, as the electron transport substance, metal complex such as tris (8-quinolinolato) aluminum (abbreviated as $Alq_3$), tris (4-methyl-8-quinolinolato) aluminum (abbreviated as $Almq_3$), bis (10-hydroxybenzo [h]-quinolinato) beryllium (abbreviated as $BeBq_2$), bis (2-methyl-8-quinolinolato)-4-phenylphenolate-aluminum (abbreviated as BAlq), bis [2-(2-hydroxyphenyl) benzoxazolato] zinc (abbreviated as $Zn(BOX)_2$), and bis [2-(2-hydroxyphenyl) benzothiazolato] zinc (abbreviated as $Zn(BTZ)_2$) can be used, and 2-(4-biphenylyl)-5-(4-tert-butylphenyl)-1,3,4-oxadiazole (abbreviated as PBD), 1,3-bis [5-(p-tert-butylphenyl)-1,3,4-oxadiazole-2-yl] benzene (abbreviated as OXD-7), 3-(4-tert-butylphenyl)-4-phenyl-5-(4-biphenylyl)-1,2,4-triazole (abbreviated as TAZ), 3-(4-tert-butylphenyl)-4-(4-ethylphenyl)-5-(4-biphenylyl)-1,2,4-triazole (abbreviated as p-EtTAZ), bathophenanthroline (abbreviated as BPhen), bathocuproin (abbreviated as BCP), and the like can also be used. A substance exhibiting an electron donating property to the electron transport substance is not specifically limited. For example, an alkali metal such as lithium and cesium, an alkaline-earth metal such as magnesium and calcium, and a rare earth metal such as erbium and ytterbium can be used as the substance. A substance selected from among alkali metal oxides and alkaline-earth metal oxides such as lithium oxide ($Li_2O$), calcium oxide (CaO), sodium oxide ($Na_2O$), potassium oxide ($K_2O$), and magnesium oxide (MgO) may be used as the substance exhibiting the electron donating property to the electron transport substance.

For example, to obtain red-based light emission, a substance exhibiting light emission having a peak of emission spectrum in a range from 600 nm to 680 nm can be used, such as 4-dicyanomethylene-2-isopropyl-6-[2-(1,1,7,7-tetramethyljulolidine-9-yl) ethenyl]-4H-pyrane (abbreviated as DCJTI), 4-dicyanomethylene-2-methyl-6-[2-(1,1,7,7-tetramethyljulolidine-9-yl) ethenyl]-4H-pyrane (abbreviated as DCJT), 4-dicyanomethylene-2-tert-butyl-6-[2-(1,1,7,7-tetramethyljulolidine-9-yl) ethenyl]-4H-pyrane (abbreviated as DCJTB), periflanthene, and 2,5-dicyano-1,4-bis [2-(10-methoxy-1,1,7,7-tetramethyljulolidine-9-yl) ethenyl] benzene. To obtain green-based light emission, a substance exhibiting light emission having a peak of emission spectrum in a range from 500 nm to 550 nm can be used, such as N,N'-dimethylquinacridone (abbreviated as DMQd), coumarin 6, coumarin 545T, and tris (8-quinolinolato) aluminum (abbreviated as $Alq_3$). To obtain blue-based light emission, a substance exhibiting light emission having a peak of emission spectrum in a range from 420 nm to 500 nm can be used, such as 9,10-bis (2-naphthyl)-tert-butylanthracene (abbreviated as t-BuDNA), 9,9'-bianthryl, 9,10-diphenylanthracene (abbreviated as DPA), 9,10-bis (2-naphthyl) anthracene (abbreviated as DNA), bis (2-methyl-8-quinolinolato)-4-phenylphenolate-gallium (abbreviated as BGaq), and bis (2-methyl-8-quinolinolato)-4-phenylphenolate-aluminum (abbreviated as BAlq). In addition to the substances that emit fluorescence as described above, substances that emit phosphorescence can also be used as light-emitting substances, such as bis [2-(3,5-bis (trifluoromethyl) phenyl) pyridinato-N,C2'] iridium (III) picolinate (abbreviated as $Ir(CF_3ppy)_2$ (pic)), bis [2-(4,6-difluorophenyl) pyridinato-N,C2'] iridium (III) acetylacetonate (abbreviated as FIr(acac)), bis [2-(4,6-difluorophenyl) pyridinato-N,C2'] iridium (III) picolinate (FIr(pic)), and tris (2-phenylpyridinato-N,C2') iridium (abbreviated as $Ir(ppy)_3$).

The upper electrode 57 is a translucent electrode made of a translucent conductive material (translucent conductive oxide) such as indium tin oxide (ITO). In the present embodiment, ITO is exemplified as the translucent conductive material, but the translucent conductive material is not limited thereto. As the translucent conductive material, a conductive material having another composition such as indium zinc oxide (IZO) may be used. The upper electrode 57 functions as a cathode (negative pole) of the organic light emitting diode E1. The insulating layer 58 is a sealing layer that seals the upper electrode described above, and can be made of silicon oxide, silicon nitride, and the like. The insulating layer 59 is a planarization layer for preventing a level difference from being generated due to the bank, and can be made of silicon oxide, silicon nitride, and the like. The substrate 50 is a translucent substrate that protects the entire image display panel 40, and can be a glass substrate, for example. FIG. 4 illustrates an example in which the lower electrode 55 is the anode (positive pole) and the upper electrode 57 is the cathode (negative pole), but the embodiment is not limited thereto. The lower electrode 55 may be the cathode and the upper electrode 57 may be the anode. In this case, the polarity of the driving transistor Tr2 electrically coupled to the lower electrode 55 can be appropriately changed, and a stacking order of a carrier injection layer (the hole injection layer and the electron injection layer), a carrier transport layer (the hole transport layer and the electron transport layer), and the light emitting layer can be appropriately changed.

The image display panel 40 is a color display panel, and the color filter 61 is arranged between the sub-pixel 49 and an image observer. The color filter 61 transmits light in a color corresponding to the color of the sub-pixel 49 from among light emitting components of the self-luminous layer 56. The image display panel 40 can emit light in the colors of red (R), green (G), blue (B), cyan (C), magenta (M), and yellow (Y). In the image display panel 40, the light emitting component of the self-luminous layer 56 may emit light in each color of the first sub-pixel 49R, the second sub-pixel 49G, the third sub-pixel 49B, the fourth sub-pixel 49C, the fifth sub-pixel 49M, and the sixth sub-pixel 49Y without using the color conversion layer such as the color filter 61.

The present embodiment exemplifies a case in which the color filter 61 that transmits light in a color corresponding to the color of the sub-pixel 49 is provided. However, the embodiment is not limited thereto. A configuration without the color filter may be employed using the self-luminous layer 56 that emits light in the colors of red (R), green (G), blue (B), cyan (C), magenta (M), and yellow (Y).

Next, the following describes an arrangement of the first sub-pixel 49R, the second sub-pixel 49G, the third sub-pixel 49B, the fourth sub-pixel 49C, the fifth sub-pixel 49M, and the sixth sub-pixel 49Y. One pixel 48 corresponds to two colors complementary to each other and includes a set of sub-pixels including two sub-pixels arranged adjacent to each other along one of the row direction and the column direction (hereinafter, the one direction is referred to as a first direction). In the present embodiment, one pixel 48 includes one or more sets of sub-pixels of two colors (hereinafter, a set of sub-pixels of two colors is referred to as a set of sub-pixels). Specifically, as illustrated in FIG. 3 for example, the pixel 48 includes at least one of the set of sub-pixels combining the first sub-pixel 49R and the fourth sub-pixel 49C, the set of sub-pixels combining the second sub-pixel 49G and the fifth sub-pixel 49M, and the set of sub-pixels combining the third sub-pixel 49B and the sixth sub-pixel 49Y. In this case, the first primary color (for example, red (R)) as the color of the first sub-pixel 49R and the complementary color of the first primary color (for example, cyan (C)) as the color of the fourth sub-pixel 49C are complementary to each other. The second primary color (for example, green (G)) as the color of the second sub-pixel 49G and the complementary color of the second primary color (for example, magenta (M)) as the color of the fifth sub-pixel 49M are complementary to each other. The third primary color (for example, blue (B)) as the color of the third sub-pixel 49B and the complementary color of the third primary color (for example, yellow (Y)) as the color of the sixth sub-pixel 49Y are complementary to each other. That is, white light can be obtained through additive color mixture of light in two colors included in each set of the sub-pixels.

In the example illustrated in FIG. 3, the leftmost pixel 48A of three pixels 48 that are aligned along the row direction in the drawing includes the set of sub-pixels combining the first sub-pixel 49R and the fourth sub-pixel 49C, and the set of sub-pixels combining the second sub-pixel 49G and the fifth sub-pixel 49M. A pixel 48B adjacent to the right side of the pixel 48A includes the set of sub-pixels combining the third sub-pixel 49B and the sixth sub-pixel 49Y, and the set of sub-pixels combining the first sub-pixel 49R and the fourth sub-pixel 49C. A pixel 48C on the right side of the pixel 48B includes the set of sub-pixels combining the second sub-pixel 49G and the fifth sub-pixel 49M, and the set of sub-pixels combining the third sub-pixel 49B and the sixth sub-pixel 49Y. In the description of the present embodiment in which the pixels 48A, 48B, and 48C are not required to be distinguished from each other, or which can be applied to all of them, each of them may be simply described as the pixel 48.

In the present embodiment, one pixel 48 includes four sub-pixels arranged to be 2×2 along the row direction and the column direction. In the present embodiment, the first sub-pixel 49R, the second sub-pixel 49G, and the third sub-pixel 49B are arranged in an upper row of sub-pixels in the pixel 48, and the fourth sub-pixel 49C, the fifth sub-pixel 49M, and the sixth sub-pixel 49Y are arranged in a lower row of sub-pixels in the pixel 48. However, this is merely an example of a relation between the colors and the arrangement of the sub-pixels 49 in the pixel 48, and the embodiment is not limited thereto and can be appropriately changed. For example, the first sub-pixel 49R, the second sub-pixel 49G, and the third sub-pixel 49B may be arranged in the lower row of sub-pixels in the pixel 48, and the fourth sub-pixel 49C, the fifth sub-pixel 49M, and the sixth sub-pixel 49Y may be arranged in the upper row of sub-pixels in the pixel 48.

The following describes the arrangement of the pixels 48 and the sub-pixels 49 according to the embodiment in more detail. As illustrated in FIG. 3, the color of the sub-pixel according to the embodiment is a color out of colors included in a predetermined number (equal to or larger than three (for example, three)) of primary colors including the first primary color, the second primary color, and the third primary color, and the complementary colors of the predetermined number of primary colors. With the combination of two colors of light that are complementary to each other, white light can be obtained through additive color mixture thereof. Specifically, in the present embodiment, the color of one sub-pixel 49 may be a color out of colors included in the three primary colors including the first primary color, the second primary color, and the third primary color (for example, red (R), green (G), and blue (B)), and the complementary colors of the three primary colors (for example, cyan (C), magenta (M), and yellow (Y)). One pixel 48 includes the sub-pixel of the primary color and the sub-pixel of the complementary color of the primary color, the number of sub-pixels of both the primary colors and the complementary colors being equal to or larger than one and less than the predetermined number (for example, two). Specifically, in the present embodiment, one pixel 48 includes two sets of sub-pixels that are complementary to each other. In other words, the number of primary colors included in one pixel 48 is two, which is less than the predetermined number. The same applies to the number of complementary colors of the primary colors.

At least one set of sub-pixels in the pixel 48 is different from the sets of sub-pixels in the pixel 48 to which the former pixel 48 is adjacent in the other one of the row direction and the column direction (hereinafter, the other direction is referred to as a second direction). In this case, the "second direction" is either one of the row direction and the column direction and is other than the "first direction". That is, the "second direction" in the example illustrated in FIG. 3 is the row direction. With reference to FIG. 3, the pixel 48C does not include the set of sub-pixels including the first sub-pixel 49R and the fourth sub-pixel 49C, but the pixels 48A and 48B adjacent to the pixel 48C in the row direction each include the above set of sub-pixels. The pixel 48B does not include the set of sub-pixels including the second sub-pixel 49G and the fifth sub-pixel 49M, but the pixels 48A and 48C adjacent to the pixel 48B in the row direction each include the above set of sub-pixels. The pixel 48A does not include the set of sub-pixels including the third sub-pixel 49B and the sixth sub-pixel 49Y, but the pixels 48B and 48C adjacent to the pixel 48A in the row direction each include the above set of sub-pixels.

In the present embodiment, a pixel region including the predetermined number of pixels aligned along the second direction includes the predetermined number (for example, three) of sub-pixels of primary colors and the same number of sub-pixels of complementary colors of the primary colors. Specifically, as illustrated in FIG. 3, in the pixel region including three pixels 48A, 48B, and 48C aligned in the row direction, there are two first sub-pixels 49R, two second sub-pixels 49G, two third sub-pixels 49B, two fourth sub-pixels 49C, two fifth sub-pixels 49M, and two sixth sub-pixels 49Y. That is, in the present embodiment, two sub-pixels 49 of each color are arranged in units of three pixels in the row direction.

Of the sets of sub-pixels included in one pixel 48 according to the embodiment, the set of sub-pixels not included in the adjacent pixel 48 is arranged on the adjacent pixel 48 side. For example, the pixel 48A does not include the set of sub-pixels including the third sub-pixel 49B and the sixth sub-pixel 49Y. Thus, in the pixel 48B, the set of sub-pixels including the third sub-pixel 49B and the sixth sub-pixel 49Y is arranged on the left side to which the pixel 48A is adjacent. The pixel 48C does not include the set of sub-pixels including the first sub-pixel 49R and the fourth sub-pixel 49C. Thus, in the pixel 48B, the set of sub-pixels including the first sub-pixel 49R and the fourth sub-pixel 49C is arranged on the right side to which the pixel 48C is adjacent. In this description, the arrangement of the set of sub-pixels in the pixel 48B is exemplified. Similarly, regarding the sets of sub-pixels included in the other pixels 48A and 48C, the set of sub-pixels not included in the adjacent pixel 48 is arranged on the adjacent pixel 48 side.

Figure 5:
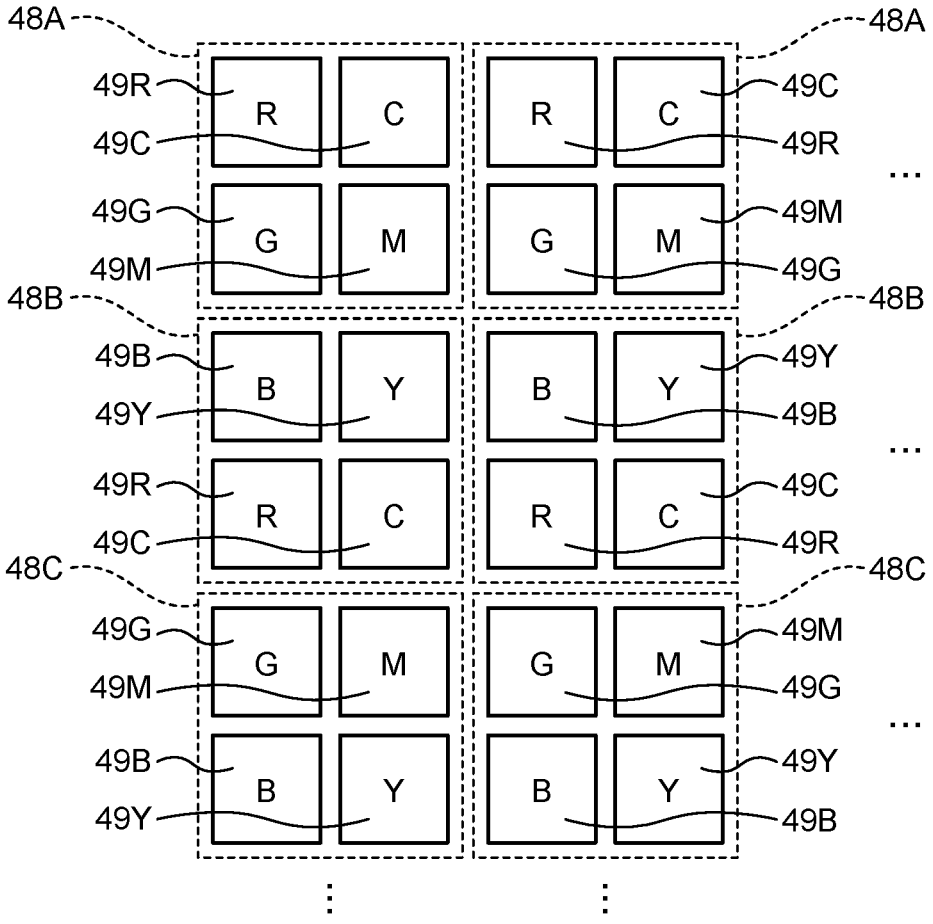
FIG. 5 is a diagram illustrating an arrangement example of sub-pixels of two colors constituting one set of sub-pixels.

FIG. 5 is a diagram illustrating an arrangement example of the sub-pixels 49 of two colors constituting one set of sub-pixels. The sub-pixels 49 of two colors constituting one set of sub-pixels are arranged adjacent to each other along one of the row direction and the column direction. In the present embodiment, as illustrated in FIG. 3, the sub-pixels 49 of two colors constituting one set of sub-pixels are arranged adjacent to each other along the column direction. Alternatively, as illustrated in FIG. 5, the sub-pixels 49 of two colors constituting one set of sub-pixels may be arranged along the row direction.

Figure 6:
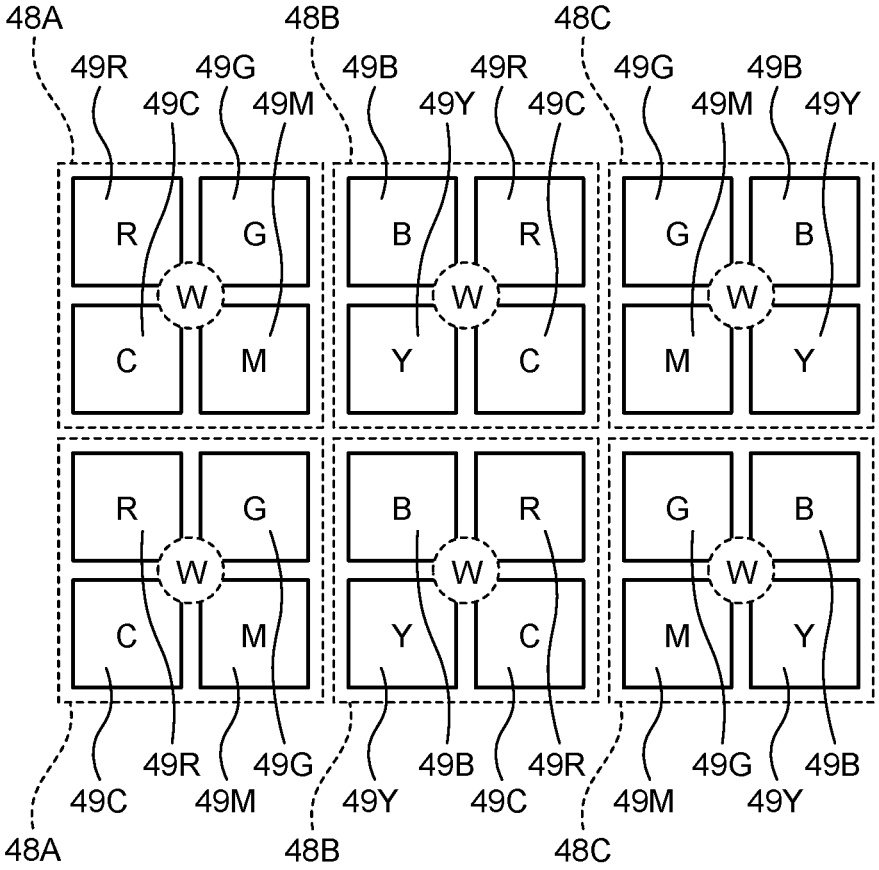
FIG. 6 is a diagram illustrating an example of a combination of sub-pixels for reproducing contrast of white light by combining outputs of adjacent sub-pixels.
Figure 7:
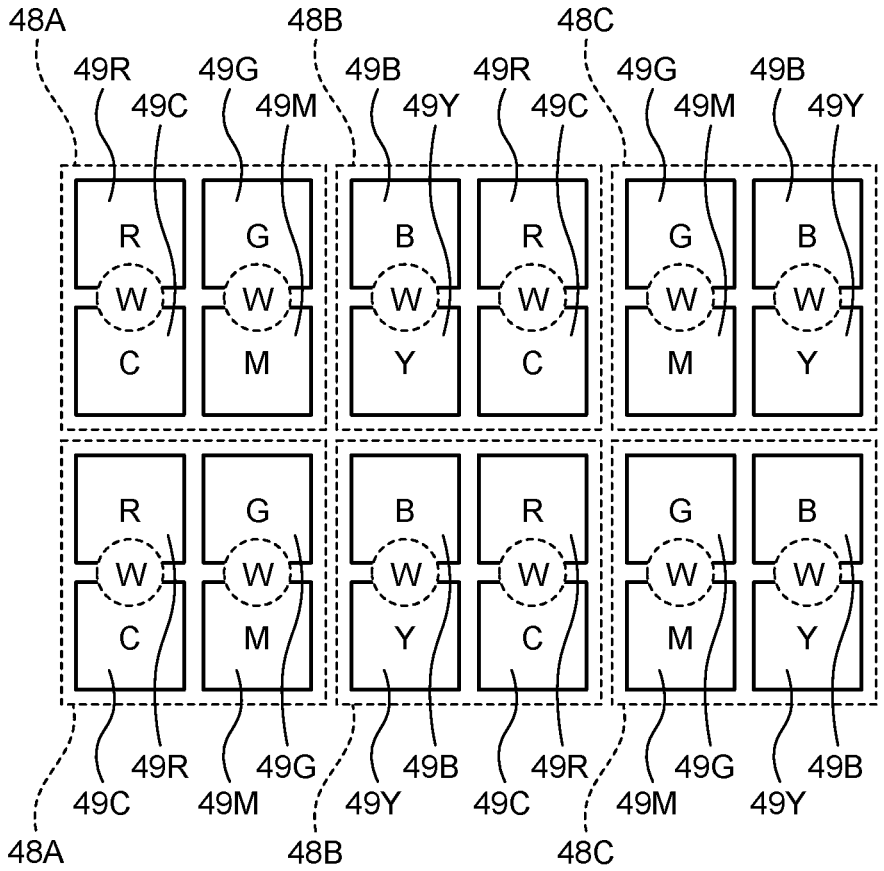
FIG. 7 is a diagram illustrating an example of the combination of sub-pixels for reproducing contrast of white light by combining outputs of adjacent sub-pixels.

FIGS. 6 and 7 are diagrams illustrating an example of a combination of sub-pixels for outputting white light by combining adjacent sub-pixels. In the present embodiment, there are two or more combinations of sub-pixels for outputting white light by combining adjacent sub-pixels for one sub-pixel. As a specific example, as illustrated in FIG. 6, each of the pixels 48A, 48B, and 48C can output white light by lighting all the sub-pixels 49 included in itself. That is, each of the pixels 48A, 48B, and 48C can reproduce contrast of white light by adjusting light emission intensity of the sub-pixels 49 included in itself.

As illustrated in FIG. 7, each of the pixels 48A, 48B, and 48C can output white light in units of a set of sub-pixels included in itself. That is, each of the pixels 48A, 48B, and 48C can output white light by adjusting the light emission intensity in units of a set of sub-pixels (for example, a set of sub-pixels adjacent to each other in the column direction) that are complementary to each other included in itself. Accordingly, for example, only one of the two sets of sub-pixels included in each of the pixels 48A, 48B, and 48C can be lit to output white light while the other one of the two sets of sub-pixels is not lit.

For example, in the pixel 48, contrast of white light can be reproduced by outputting white light with the first sub-pixel 49R and the fourth sub-pixel 49C while the second sub-pixel 49G and the fifth sub-pixel 49M are turned off. In contrast, in the pixel 48, contrast of white light can be reproduced by outputting white light with the second sub-pixel 49G and the fifth sub-pixel 49M while the first sub-pixel 49R and the fourth sub-pixel 49C are turned off.

As described above with reference to FIGS. 6 and 7, in the present embodiment, there are two or more combinations of sub-pixels for outputting white light by combining adjacent sub-pixels 49 for one sub-pixel 49. In the example illustrated in FIG. 7, each of the pixels 48A, 48B, and 48C can output light in a color other than white with the other one of the two sets of sub-pixels.

As described above, in the present embodiment, two or more types of adjustment granularity for contrast of white light can be set. Thus, resolution (black-and-white resolution) obtained through gradation expression of an image based on brightness of light can be caused to be equal to or larger than the number of pixels 48. For example, in the example illustrated in FIG. 6, the black-and-white resolution is equal to the number of pixels 48 in the row direction and the column direction. In the example illustrated in FIG. 7, the black-and-white resolution is two times the number of pixels 48 in the row direction and the column direction, that is, the resolution being equal to a resolution obtained by multiplying the number of pixels 48 by two in the row direction. In FIG. 6 and the other drawings, a control unit for contrast of white light corresponding to the black-and-white resolution is represented as a circle W of a dashed line arranged among the sub-pixels.

In the present embodiment, the pixels 48 including the same combination and arrangement of the sub-pixels 49 are continuously arranged along the column direction. Specifically, as illustrated in FIG. 3, the pixels included in a pixel column including the pixel 48A are all pixels 48A. The pixels included in a pixel column including the pixel 48B are all pixels 48B. The pixels included in a pixel column including the pixel 48C are all pixels 48C. In this way, in the present embodiment, the pixels 48 including the same combination and arrangement of the sub-pixels 49 are adjacent to each other along the column direction.

In the present embodiment, two sub-pixels 49 that are included in different pixels 48 and adjacent to each other in the first direction are complementary to each other. In this case, two sub-pixels 49 that are included in different pixels 48" means, for example, the sub-pixels 49 included in the two respective pixels 48A and 48A adjacent to each other along the column direction in FIG. 3. The following is a description focusing on the two pixels 48A and 48A. The "first direction" is a direction in which the sub-pixels 49 of two colors constituting the set of sub-pixels are adjacent to each other, and is the column direction in the present embodiment as illustrated in FIG. 3. That is, "two sub-pixels that are included in different pixels 48 and adjacent to each other in the first direction" means, for example, the fourth sub-pixel 49C included in an upper pixel 48A and the first sub-pixel 49R included in a lower pixel 48A illustrated in FIG. 3. In this case, the color of the fourth sub-pixel 49C included in the upper pixel 48A is the complementary color of the first primary color (for example, cyan (C)). The color of the first sub-pixel 49R included in the lower pixel 48A is the first primary color (for example, red (R)). In this way, according to the present embodiment, the two sub-pixels 49 that are included in different pixels 48 and adjacent to each other in the first direction are complementary to each other.

A relation between the fifth sub-pixel 49M included in the upper pixel 48A and the second sub-pixel 49G included in the lower pixel 48A illustrated in FIG. 3 also corresponds to the "two sub-pixels 49 that are included in different pixels 48 and adjacent to each other in the first direction". The color of the fifth sub-pixel 49M included in the upper pixel 48A is the complementary color of the second primary color (for example, magenta (M)). The color of the second sub-pixel 49G included in the lower pixel 48A is the second primary color (for example, green (G)). Accordingly, such two sub-pixels 49 also are complementary to each other. Not only in the pixel column of the pixels 48A but also in respective pixel columns of the pixels 49B and 49C, the two sub-pixels 49 that are included in different pixels 48 and adjacent to each other in the first direction are complementary to each other.

Figure 8:
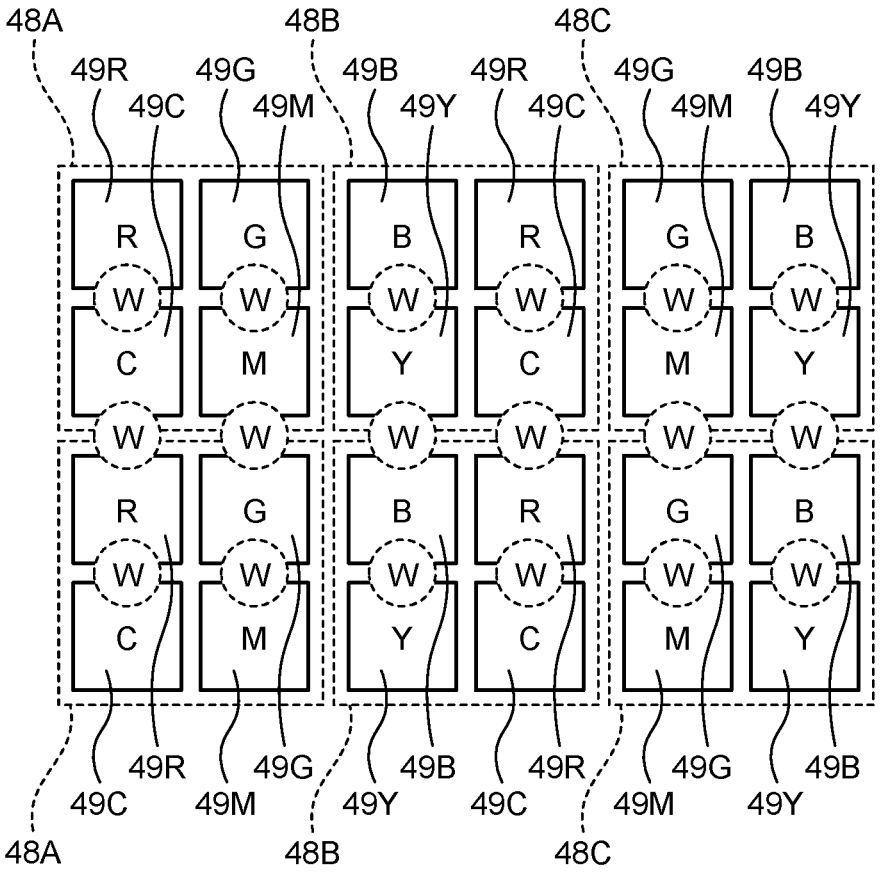
FIG. 8 is a diagram illustrating another pattern of the combination of sub-pixels for reproducing contrast of white light.

FIG. 8 is a diagram illustrating another pattern of the combination of sub-pixels for outputting white light. In the present embodiment, there is a combination of the sub-pixels 49 for outputting white light by combining adjacent sub-pixels 49 included in different pixels 48. Specifically, as illustrated in FIG. 8, white light can be output with the fourth sub-pixel 49C included in the upper pixel 48A and the first sub-pixel 49R included in the lower pixel 48A. White light can also be output with the fifth sub-pixel 49M included in the upper pixel 48A and the second sub-pixel 49G included in the lower pixel 48A. As described above with reference to FIG. 7, white light can be output in units of a set of sub-pixels that are complementary to each other included in the pixel 48A. Accordingly, in the example illustrated in FIG. 8, the black-and-white resolution is substantially doubled in the column direction. More strictly speaking, obtained is the black-and-white resolution corresponding to a number obtained by subtracting one from the number of the sub-pixels 49 included in the column direction.

Figure 9:
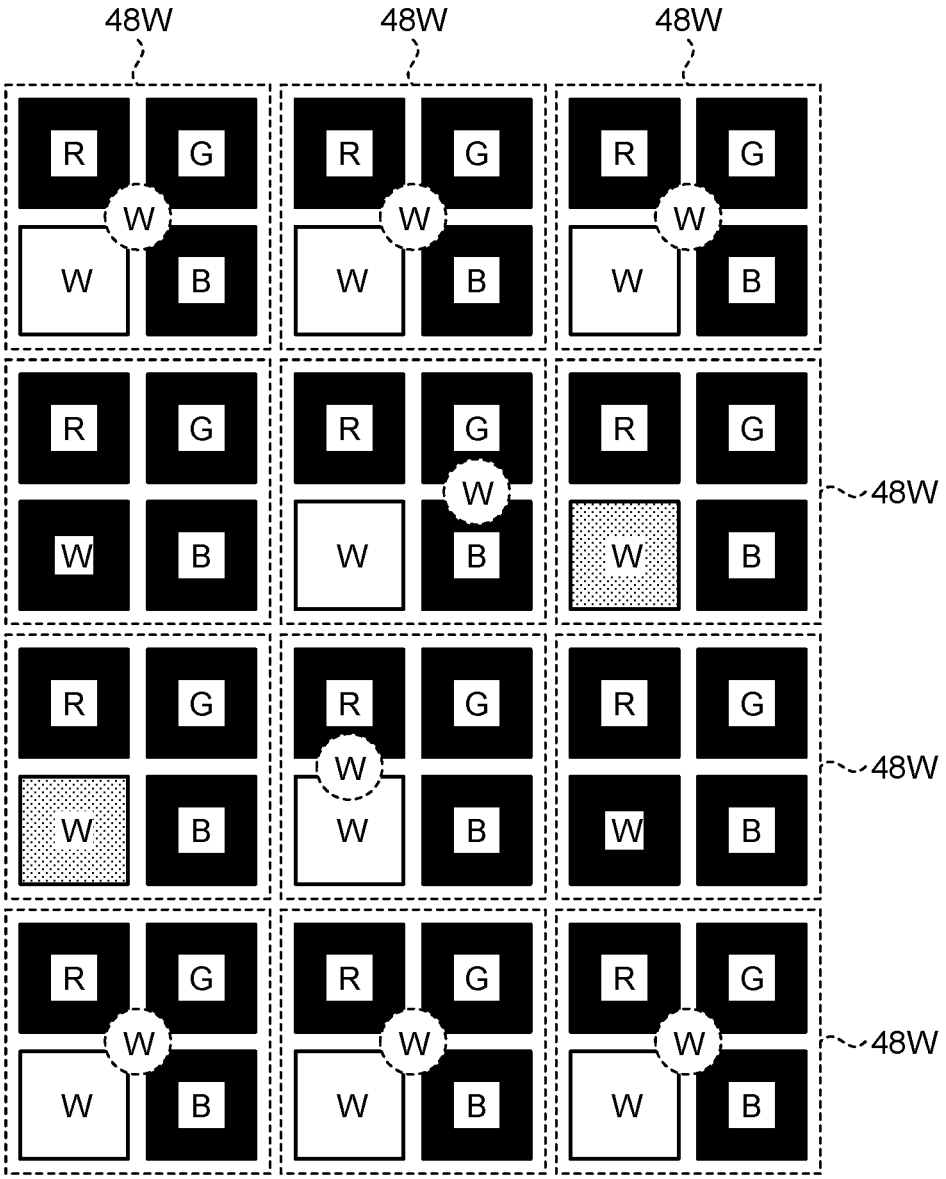
FIG. 9 is a diagram illustrating an example of a display output corresponding to a certain input image.
Figure 10:
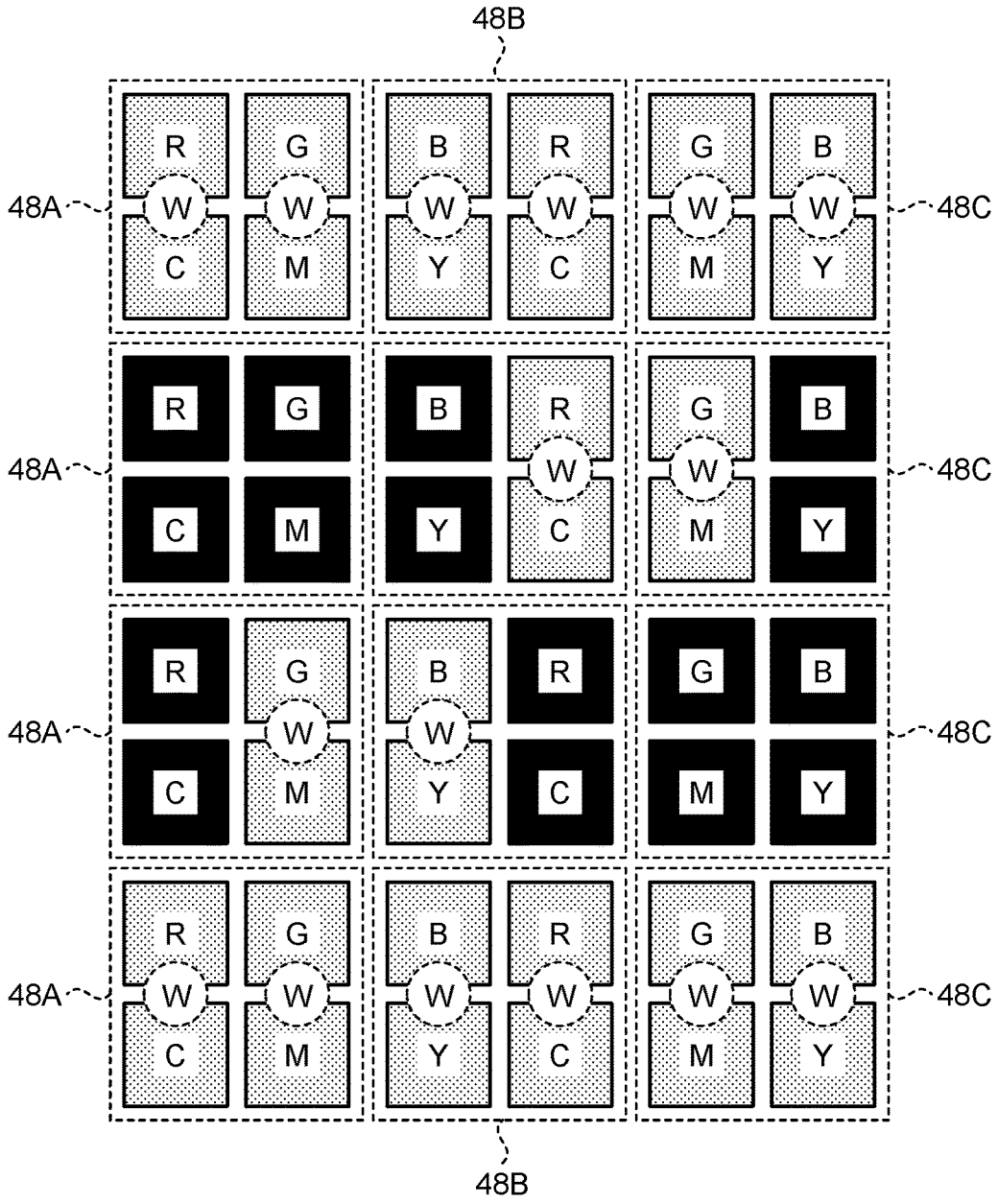
FIG. 10 is a diagram illustrating an example of a display output corresponding to a certain input image.
Figure 11:
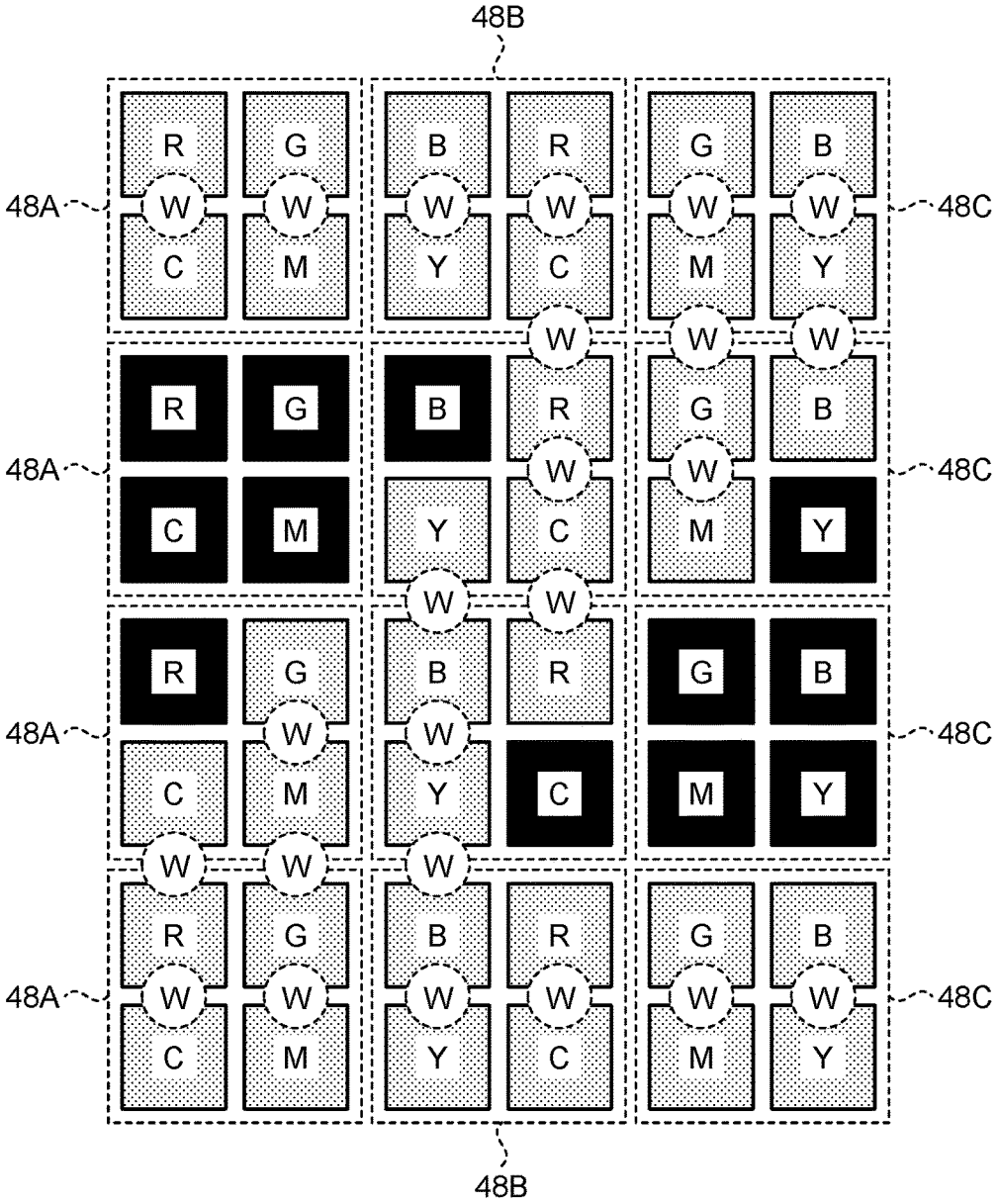
FIG. 11 is a diagram illustrating an example of a display output corresponding to a certain input image.

FIGS. 9, 10, and 11 are diagrams illustrating an example of a display output corresponding to a certain input image. As a reference example, FIG. 9 illustrates a case in which pixels 48W are arranged. Each of the pixels 48W includes 2×2 sub-pixels, and the colors of the sub-pixels are red (R), green (G), blue (B), and white (W). For example, assumed is an input image representing content of the display output corresponding to a white character in "Z" shape on a black background in a pixel region including 3×4 pixels 48 in the row direction and the column direction. In this case, when output is performed with the pixel including the sub-pixel of white (W), the black-and-white resolution is equal to the number of pixels as illustrated in FIG. 9. In contrast, when contrast of white light is reproduced with the respective two sets of sub-pixels included in one pixel 48 as described above with reference to FIG. 7, the black-and-white resolution is two times the number of the pixels 48 in the row direction, so that the "Z" shape of the white character is output more accurately as compared with FIG. 9 as illustrated in FIG. 10. As described above with reference to FIG. 8, when contrast of white light is reproduced by combining outputs of the sub-pixels 49 included in different pixels 48, the black-and-white resolution is further substantially doubled in the column direction, so that the "Z" shape of the white character is output more accurately as compared with FIGS. 9 and 10 as illustrated in FIG. 11.

Figure 12:
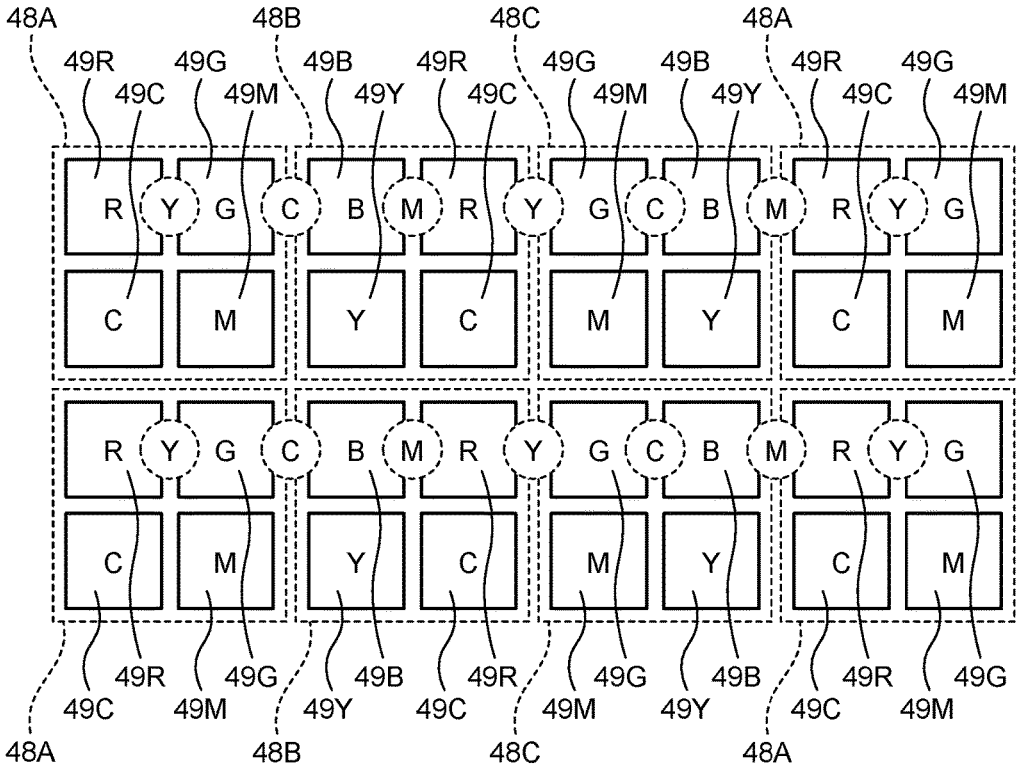
FIG. 12 is a diagram illustrating an example of effective resolution of a complementary color of a first primary color, a complementary color of a second primary color, and a complementary color of a third primary color.

FIG. 12 is a diagram illustrating an example of effective resolution of the complementary color of the first primary color, the complementary color of the second primary color, and the complementary color of the third primary color. In the present embodiment, in addition to the reproduction of contrast of white light, more various display output can be performed by combining the arrangement and a light emitting state of the sub-pixels 49. For example, as illustrated in FIG. 12, the pixel 48A can reproduce the complementary color (yellow (Y)) of the third primary color by combining the color of the first sub-pixel 49R (red (R)) and the color of the second sub-pixel 49G (green (G)) adjacent to each other in the row direction. The pixel 48B can reproduce the complementary color (magenta (M)) of the second primary color by combining the color of the third sub-pixel 49B (blue (B)) and the color of the first sub-pixel 49R (red (R)) adjacent to each other in the row direction. The pixel 48C can reproduce the complementary color (cyan (C)) of the first primary color by combining the color of the second sub-pixel 49G (green (G)) and the color of the third sub-pixel 49B (blue (B)) adjacent to each other in the row direction. In FIG. 12, control units of contrast of the complementary colors (cyan (C), magenta (M), and yellow (Y)), each of which is a combination of the sub-pixels 49 of the primary colors (the first sub-pixel 49R, the second sub-pixel 49G, and the third sub-pixel 49B), are represented by a circle C, a circle M, and a circle Y of a dashed line arranged among the sub-pixels.

More various display outputs can be performed by combining outputs of the sub-pixels 49 that are adjacent to each other and included in different pixels 48. Specifically, as illustrated in FIG. 12, the complementary color (cyan (C)) of the first primary color can be reproduced by combining the color of the second sub-pixel 49G (green (G)) in the pixel 48A and the color of the third sub-pixel 49B (blue (B)) in the pixel 48B adjacent to each other in the row direction. The complementary color (yellow (Y)) of the third primary color can be reproduced by combining the color of the first sub-pixel 49R (red (R)) in the pixel 48B and the color of the second sub-pixel 49G (green (G)) in the pixel 48C adjacent to each other in the row direction. The complementary color (magenta (M)) of the second primary color can be reproduced by combining the color of the third sub-pixel 49B (blue (B)) in the pixel 48C and the color of the first sub-pixel 49R (red (R)) in the pixel 48A adjacent to each other in the row direction.

Figure 13:
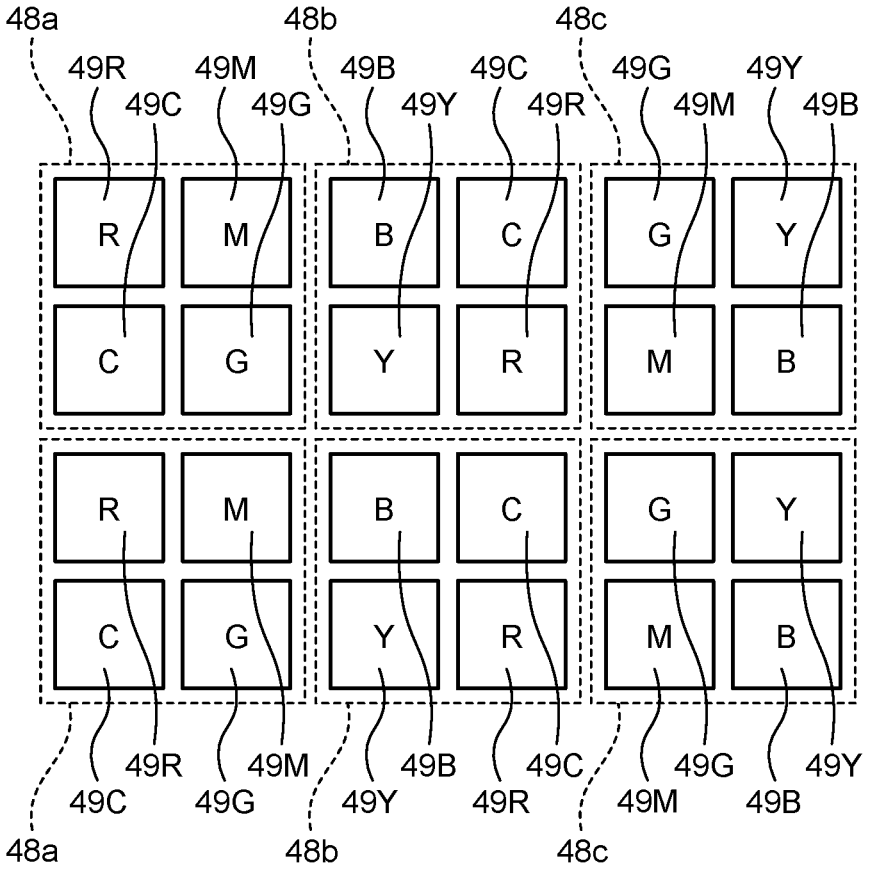
FIG. 13 is a diagram illustrating another example of an arrangement of colors of the sub-pixels.
Figure 14:
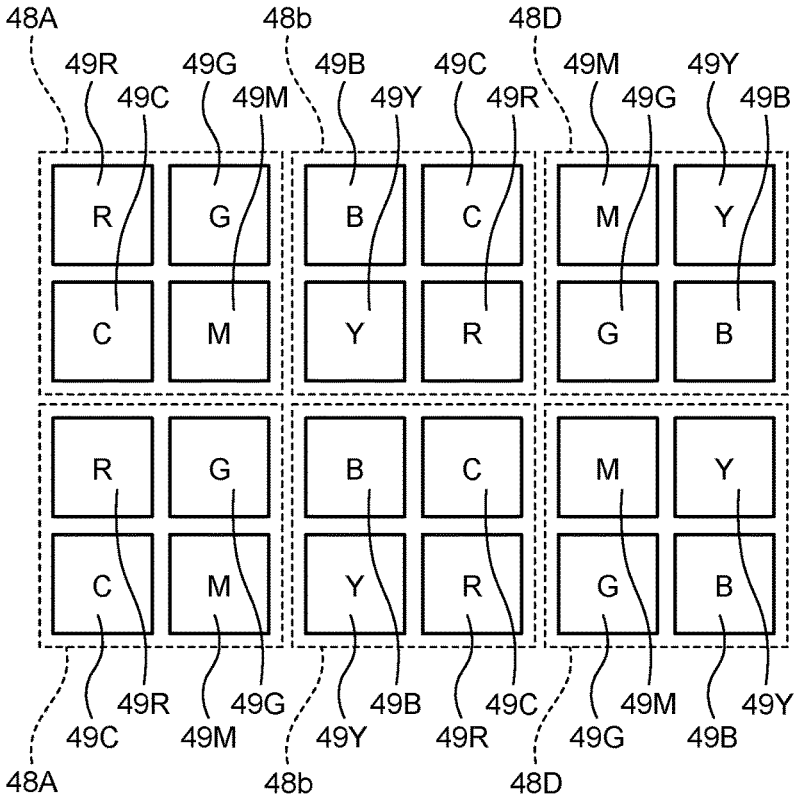
FIG. 14 is a diagram illustrating another example of the arrangement of the colors of the sub-pixels.

FIGS. 13 and 14 are diagrams illustrating another example of the arrangement of the colors of the sub-pixels 49. In the example illustrated in FIG. 3, the sub-pixels of the primary colors (the first sub-pixel 49R, the second sub-pixel 49G, and the third sub-pixel 49B) and the sub-pixels of the complementary colors (the fourth sub-pixel 49C, the fifth sub-pixel 49M, and the sixth sub-pixel 49Y) are arranged in parallel, and there is no row of sub-pixels including both of the primary color and the complementary color. However, this is merely an example of the arrangement of the colors of the sub-pixels 49, and the embodiment is not limited thereto. For example, as illustrated in FIGS. 13 and 14, the sub-pixel of the primary color and the sub-pixel of the complementary color may be arranged in a staggered manner. In the example illustrated in FIG. 13, the sub-pixels are arranged in a staggered manner in units of one sub-pixel in the row direction. That is, in the example illustrated in FIG. 13, the pixels 48*a*, 48*b*, and 48*c* are arranged in the row direction and the column direction, and the colors of the upper sub-pixel 49 and the lower sub-pixel 49 constituting the right set of sub-pixels in each of the pixels 48*a*, 48*b*, and 48*c* are reversed in position with respect to the arrangement of the colors of the right set of sub-pixels 49 in the pixels 48A, 48B, and 48C illustrated in FIG. 3. In the example illustrated in FIG. 14, the sub-pixels are arranged in a staggered manner in units of three sub-pixels in the row direction. That is, in the example illustrated in FIG. 14, the pixels 48A, 48*b*, and 48D are arranged in the row direction and in the column direction, the colors of the upper sub-pixel 49 and lower sub-pixel 49 constituting the right set of sub-pixels in the pixel 48*b* are reversed in position with respect to the arrangement of the colors of the right set of sub-pixels 49 in the pixel 48B illustrated in FIG. 3, and the colors of the upper sub-pixel 49 and lower sub-pixel 49 constituting each of the sets of sub-pixels in the pixel 48D are reversed in position with respect to the arrangement of the colors of the respective sets of sub-pixels 49 in the pixel 48C illustrated in FIG. 3.

With all of the pixels illustrated in FIG. 13 and the pixels illustrated in the middle of the row direction of the pixels illustrated in FIG. 14, the complementary color can be output by combining the sub-pixels of the primary colors diagonally arranged in the pixel 48 similarly to the example described above with reference to FIG. 12. A mechanism of outputting white light and the complementary colors by combining the colors of the sub-pixels 49 included in different pixels can be applied to the examples illustrated in FIG. 13 and the FIG. 14.

The reproduction of white light and the complementary colors (for example, cyan (C), magenta (M), and yellow (Y)) has been described above. However, the colors reproduced by combining the colors of the sub-pixels 49 are not limited thereto. Color reproduction can be performed more variously with light emission intensity (a gradation value) of each of the sub-pixels 49.

Figure 15:
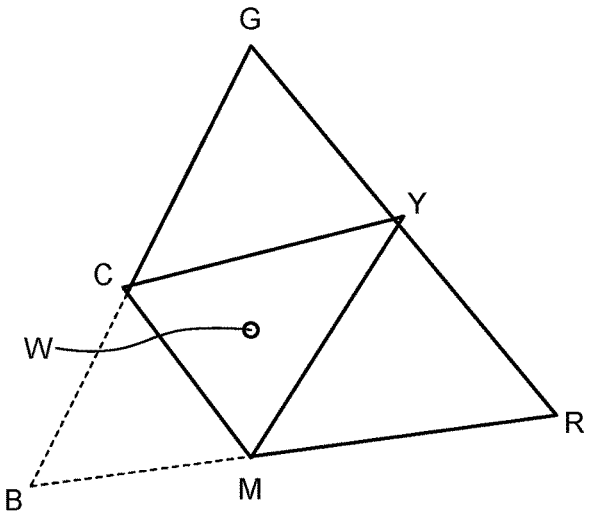
FIG. 15 is a schematic diagram illustrating a color space that can be reproduced using sub-pixels included in one pixel.
Figure 16:
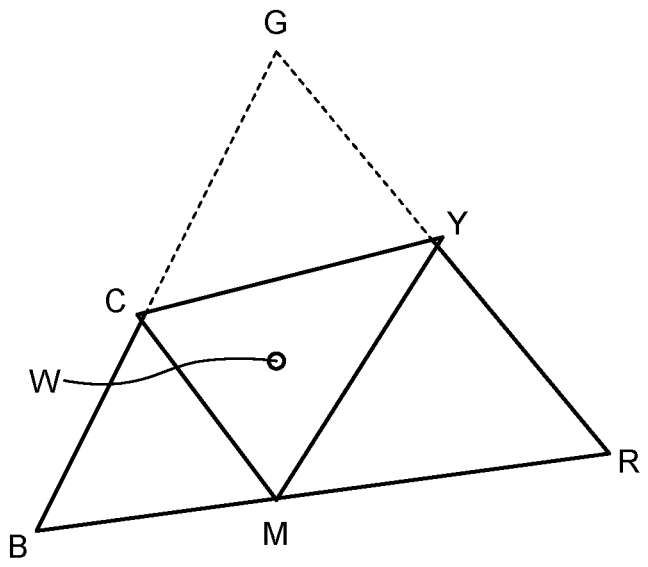
FIG. 16 is a schematic diagram illustrating a color space that can be reproduced using sub-pixels included in one pixel.
Figure 17:
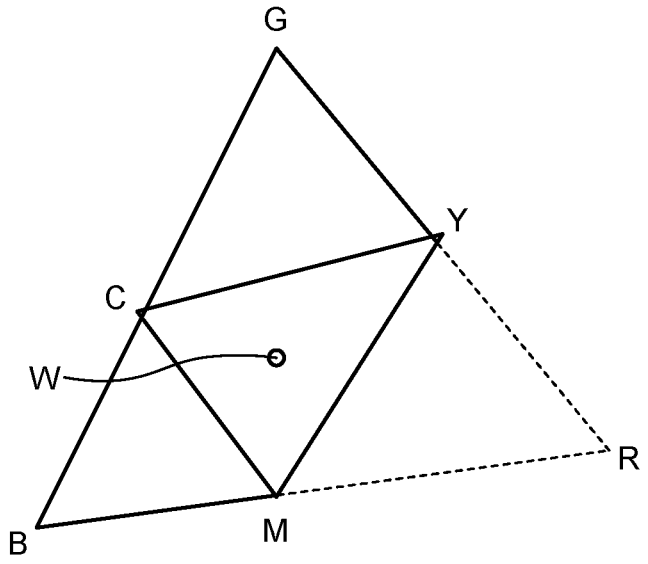
FIG. 17 is a schematic diagram illustrating a color space that can be reproduced using sub-pixels included in one pixel.

FIGS. 15, 16, and 17 are schematic diagrams illustrating a color space that can be reproduced using the sub-pixels 49 included in one pixel 48. FIGS. 15, 16, and 17 each illustrate a color space that can be reproduced using the sub-pixels 49 included in each of the pixels 48A, 48B, and 48C. Taking the pixel 48A as an example, the pixel 48A includes the first sub-pixel 49R, the second sub-pixel 49G, the fourth sub-pixel 49C, and the fifth sub-pixel 49M, so that the first primary color, the second primary color, the complementary color of the first primary color, and the complementary color of the second primary color can be reproduced with light of each sub-pixel 49. As described above with reference to FIG. 12, the pixel 48A can reproduce the complementary color of the third primary color by combining the first primary color and the second primary color. Due to this, as illustrated in FIG. 15, the pixel 48A can perform, by the one pixel, color reproduction other than color reproduction that requires light of the third sub-pixel 49B of the third primary color. In other words, one pixel can perform color reproduction other than color reproduction that requires the primary color not included in itself. Thus, as illustrated in FIG. 16, the pixel 48B can perform, by itself, color reproduction other than color reproduction that requires light of the second sub-pixel 49G the second primary color. As illustrated in FIG. 17, the pixel 48C can perform, by itself, color reproduction other than color reproduction that requires light of the first sub-pixel 49R of the first primary color.

To put the description with reference to FIGS. 15, 16, and 17 another way, one pixel cannot perform color reproduction that requires light in the primary color not included in the one pixel. The pixels 48A, 48B, and 48C can independently perform color reproduction in some cases depending on an RGB gradation value indicated by an input signal (refer to FIG. 18). However, for example, when the input signal for a display output content that requires light in the third primary color is input for the pixel 48A, color reproduction corresponding to such display output content cannot be performed by only the pixel 48A (refer to FIG. 19). The signal processing unit 20 according to the present embodiment performs processing (sub-pixel rendering processing) for assigning an output of the primary color not included in a specific pixel to another pixel (or other pixels) including the sub-pixel of the primary color out of the colors of the sub-pixels that are required to emit light in accordance with the input signal. Hereinafter, a singular form "another pixel" includes not only the singular form itself but also the plural form "other pixels", unless the context clearly indicates that the singular form only includes the singular form.

Figure 18:
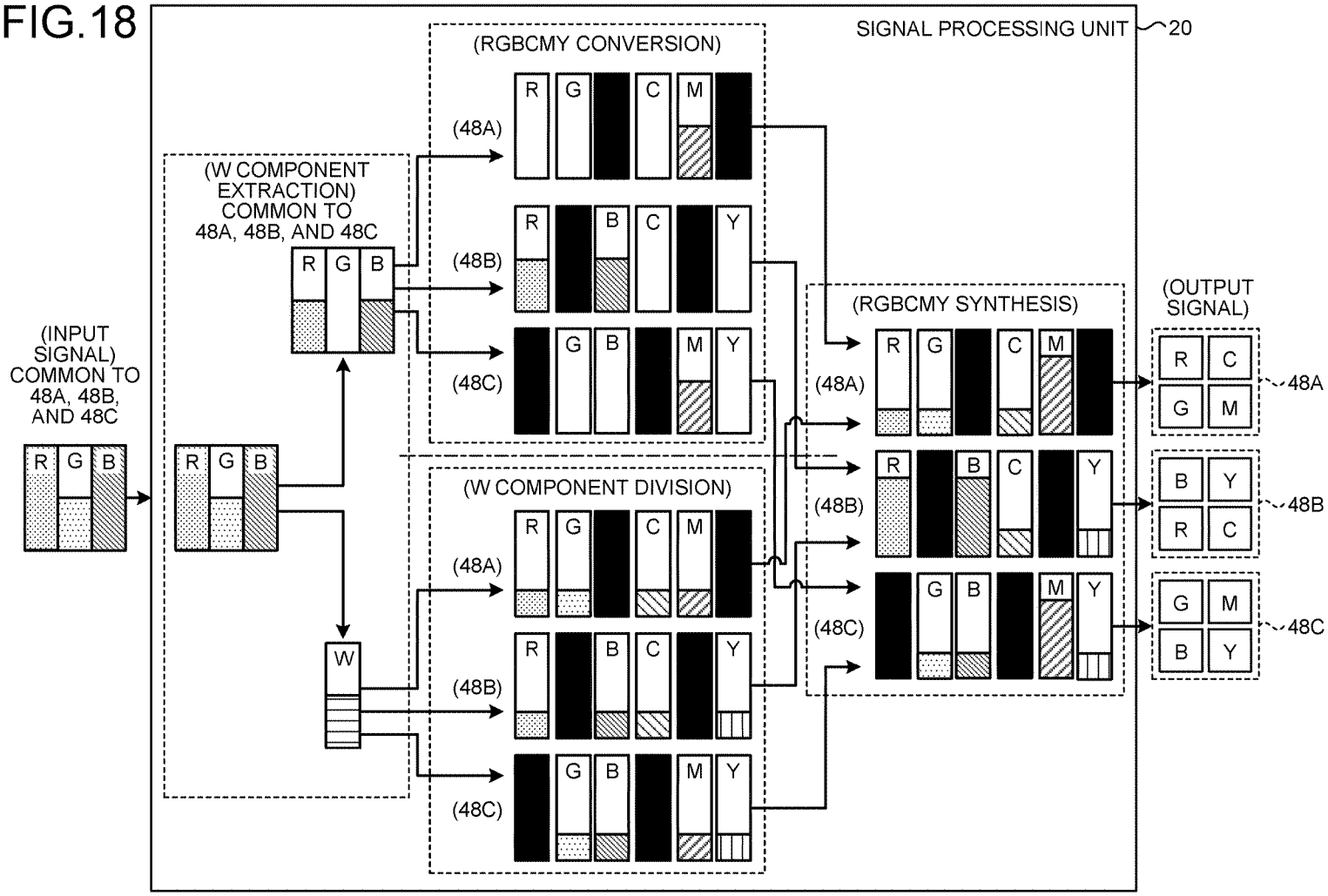
FIG. 18 is an explanatory diagram illustrating an example of processing performed by a signal processing unit.
Figure 19:
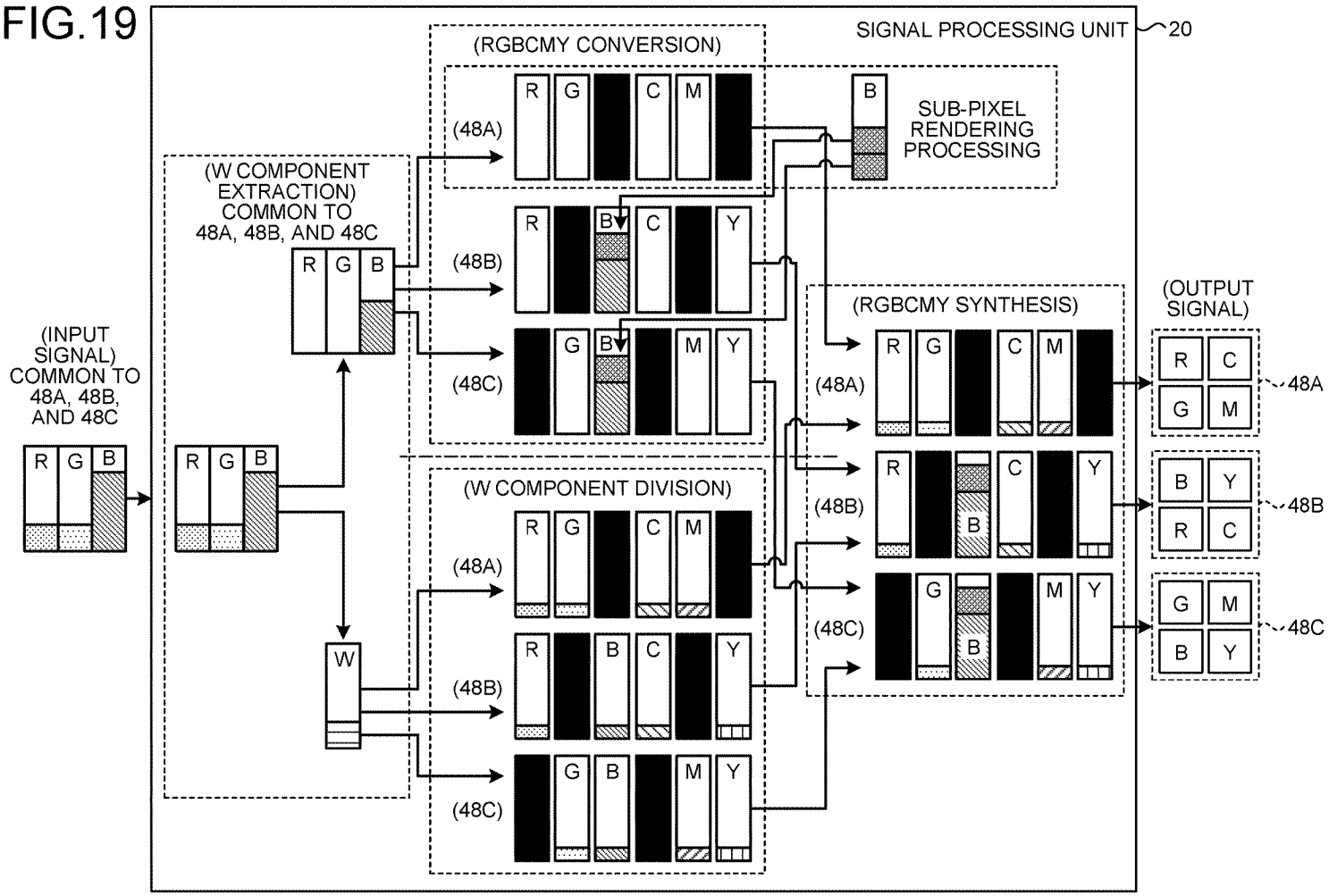
FIG. 19 is an explanatory diagram illustrating an example of processing performed by the signal processing unit.
Figure 20:
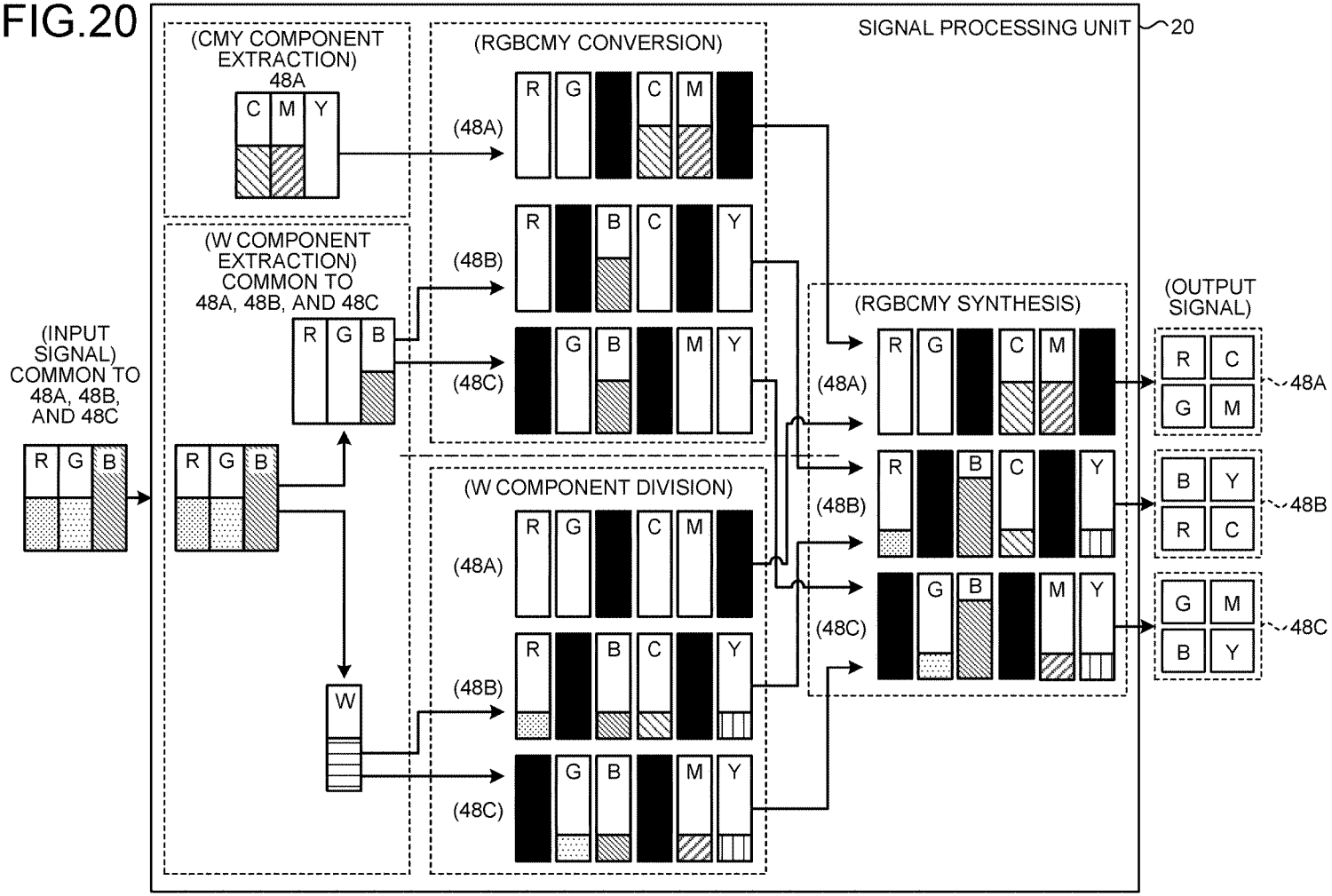
FIG. 20 is an explanatory diagram illustrating an example of processing performed by the signal processing unit.

FIG. 18 is an explanatory diagram illustrating an example of processing performed by the signal processing unit 20. With reference to FIG. 18, described is an example in which the input signal of (R, G, B)=(255, 128, 255) the colors of which the pixels 48A, 48B, and 48C can independently reproduce is input for each of the three pixels 48A, 48B, and 48C. In FIGS. 18 to 20, the sub-pixel 49 of each color is represented as a white rectangle in which a character indicating the color of the sub-pixel 49 is illustrated. When there is a masking pattern in the white rectangle, the color component corresponding to the color of the sub-pixel 49 is not zero. When the rectangle has no masking pattern, that is, the rectangle only has the character indicating the color, the color component is zero. A black rectangle in FIGS. 18 to 20 indicates the sub-pixel 49 of the primary color or the complementary color not included in each of the pixels 48A, 48B, and 48C. Specifically, for example, the pixel 48A does not include the third sub-pixel 49B and the sixth sub-pixel 49Y, so that black rectangles are arranged at positions that correspond to the positions where the third sub-pixel 49B and the sixth sub-pixel 49Y are arranged in the other pixels 48B and 48C. Similarly, in the pixel 48B, the black rectangles are arranged at positions that correspond to the positions where the second sub-pixel 49G and the fifth sub-pixel pixel 49M are arranged in the other pixels 48A and 48C. In the pixel 48C, the black rectangles are arranged at positions that correspond to the positions where the first sub-pixel 49R and the fourth sub-pixel 49C are arranged in the other pixels 48A and 48B.

The signal processing unit 20 performs processing for extracting a white component (Wout) from the input signal to separate the input signal into the white component and the color component other than the white component (W component extraction). Specifically, the input signal of (R, G, B)=(255, 128, 255) illustrated in FIG. 18 can be separated into the white component of (R, G, B)=(128, 128, 128) and the color component of (R, G, B)=(127, 0, 127), which is the color component other than the white component.

The signal processing unit 20 performs processing for dividing the color component (W component division) to output the white component by combining the colors of the sub-pixels 49 included in each pixel 48. For example, in a case of W component division in which the white component is divided into the first primary color, the second primary color, the complementary color of the first primary color, and the complementary color of the second primary color that are the colors of the sub-pixels 49 constituting the pixel 48A, the signal processing unit 20 divides the white component of (R, G, B)=(128, 128, 128) into a red (R) component of (R, G, B)=(64, 0, 0), a green (G) component of (R, G, B)=(0, 64, 0), a cyan (C) component of (R, G, B)=(0, 64, 64), and a magenta (M) component of (R, G, B)=(64, 0, 64). When the signal processing unit 20 performs W component division, the white component in the pixel 48A is divided into (R, G, B, C, M, Y)=(64, 64, 0, 64, 64, 0) as gradation values of RGBCMY. Similarly, the signal processing unit 20 divides the white components in the pixels 48B and 48C into (R, G, B, C, M, Y)=(64, 0, 64, 64, 0, 64) and (0, 64, 64, 0, 64, 64), respectively.

The signal processing unit 20 performs conversion processing (RGBCMY conversion) to output the color component other than the white component by combining the colors of the sub-pixels 49 included in each pixel 48. For example, the color component of (R, G, B)=(127, 0, 127) can be converted into (C, M, Y)=(0, 127, 0). Thus, the signal processing unit 20 converts the color component of (R, G, B)=(127, 0, 127) in the pixels 48A and 48C into (R, G, B, C, M, Y)=(0, 0, 0, 0, 127, 0) through RGBCMY conversion, the pixels 48A and 48C including the fifth sub-pixel 49M as the sub-pixel of the complementary color of the second primary color. The pixel 48B does not include the fifth sub-pixel 49M but includes the first sub-pixel 49R as the sub-pixel of the first primary color and the third sub-pixel 49B as the sub-pixel of the third primary color, so that the pixel 48B can directly output the color component of (R, G, B)=(127, 0, 127). In this case, the signal processing unit 20 converts the color component of (R, G, B)=(127, 0, 127) in the pixel 48B into (R, G, B, C, M, Y)=(127, 0, 127, 0, 0, 0) through RGBCMY conversion.

As described above, the signal processing unit 20 performs RGBCMY conversion so as to give priority to outputs of the colors of sub-pixels 49 included in each pixel 48. Specifically, regarding the pixel 48A, the signal processing unit 20 performs R/C/G/M preferential conversion that gives priority to the first primary color, the complementary color of the first primary color, the second primary color, and the complementary color of the second primary color. Similarly, the signal processing unit 20 performs B/Y/R/C preferential conversion and G/M/B/Y preferential conversion for the pixels 48B and 48C, respectively.

The signal processing unit 20 performs processing for synthesizing the color components obtained through the W component division and the color components obtained through the RGBCMY conversion in units of the pixel 48 to obtain an output signal for each pixel 48 (RGBCMY synthesis). For example, the signal processing unit 20 synthesizes an RGBCMY gradation value of (R, G, B, C, M, Y)=(64, 64, 0, 64, 64, 0) obtained through the W component division and the RGBCMY gradation value of (R, G, B, C, M, Y)=(0, 0, 0, 0, 127, 0) obtained through the RGBCMY conversion for the pixel 48A to obtain the RGBCMY gradation value of (R, G, B, C, M, Y)=(64, 64, 0, 64, 191, 0). The signal processing unit 20 outputs a signal indicating this gradation value as an output signal for the pixel 48A. The signal processing unit 20 also performs RGBCMY synthesis for the pixels 48B and 48C using a similar mechanism, and outputs signals indicating gradation values of (R, G, B, C, M, Y)=(191, 0, 191, 64, 0, 64) and (0, 64, 64, 0, 191, 64) as output signals for the pixels 48B and 48C, respectively.

FIG. 19 is an explanatory diagram illustrating an example of processing performed by the signal processing unit 20. With reference to FIG. 19, described is an example in which the input signal of (R, G, B)=(64, 64, 192) including a color component that the pixel 48A cannot independently reproduce is input for each of the three pixels 48A, 48B, and 48C.

In the example illustrated in FIG. 19, the signal processing unit 20 obtains the white component of (R, G, B)=(64, 64, 64) and the color component of (R, G, B)=(0, 0, 128) as the color component other than the white component through the W component extraction. The W component division is the same as that in the example illustrated in FIG. 18. In the example illustrated in FIG. 19, (R, G, B, C, M, Y)=(32, 32, 0, 32, 32, 0), (32, 0, 32, 32, 0, 32), and (0, 32, 32, 0, 32, 32) are obtained, respectively, based on the white component of (R, G, B)=(64, 64, 64) as the white components in the pixels 48A, 48B, and 48C.

In the example illustrated in FIG. 19, the color component of (R, G, B)=(0, 0, 128) as the color component other than the white component cannot be converted into another component. Thus, an output corresponding to the color component of (R, G, B)=(0, 0, 128) cannot be performed by the pixel 48A not including the third sub-pixel 49B. In this case, the signal processing unit 20 performs sub-pixel rendering processing to assign the color component that cannot be output by one pixel 48 (for example, the pixel 48A) to another pixel 48 (for example, the pixel 48B and the pixel 48C) including the sub-pixel 49 of the color component. Specifically, for example, the signal processing unit 20 separates the color component of (R, G, B)=(0, 0, 128) in the pixel 48A into two color components of (R, G, B)=(0, 0, 64) to be assigned to third sub-pixels 49B included in the pixels 48B and 48C, respectively. As a result of the sub-pixel rendering processing, the color components other than the white component in the pixels 48A, 48B, and 48C become (R, G, B)=(0, 0, 0), (0, 0, 192), and (0, 0, 192), respectively.

In the present embodiment, the signal processing unit 20 performs sub-pixel rendering processing as needed to perform RGBCMY conversion. In the example illustrated in FIG. 19, the signal processing unit 20 performs RGBCMY conversion including the sub-pixel rendering processing to convert the color components of (R, G, B)=(0, 0, 128) in the pixels 48A, 48B, and 48C into (R, G, B, C, M, Y)=(0, 0, 0, 0, 0, 0), (0, 0, 192, 0, 0, 0), and (0, 0, 192, 0, 0, 0), respectively. The RGBCMY synthesis is the same as that in FIG. 18. Accordingly, the signal processing unit 20 obtains the gradation values of (R, G, B, C, M, Y)=(32, 32, 0, 32, 32, 0), (32, 0, 224, 32, 0, 32), and (0, 32, 224, 0, 32, 32) as the gradation values indicated by the output signals for the pixels 48A, 48B, and 48C, respectively.

The sub-pixel rendering processing has been described above taking the pixel 48A and the third primary color as an example. Regarding the other primary colors, the gradation value is assigned from the pixel 48 not including the primary color to another pixel 48 including the primary color using the same mechanism.

The white component is obtained by extracting, for example, the gradation value equal to the minimum gradation value of RGB gradation values indicated by the input signal from each of the gradation values of RGB indicated by the input signal. However, this is merely an example of a method for determining the white component, and the embodiment is not limited thereto. For example, the gradation value of RGB obtained by multiplying the thus extracted component by a predetermined gain value (Wgain) may be caused to be the white component. The predetermined gain value is larger than 0 and equal to or smaller than 1.

Figure 21:
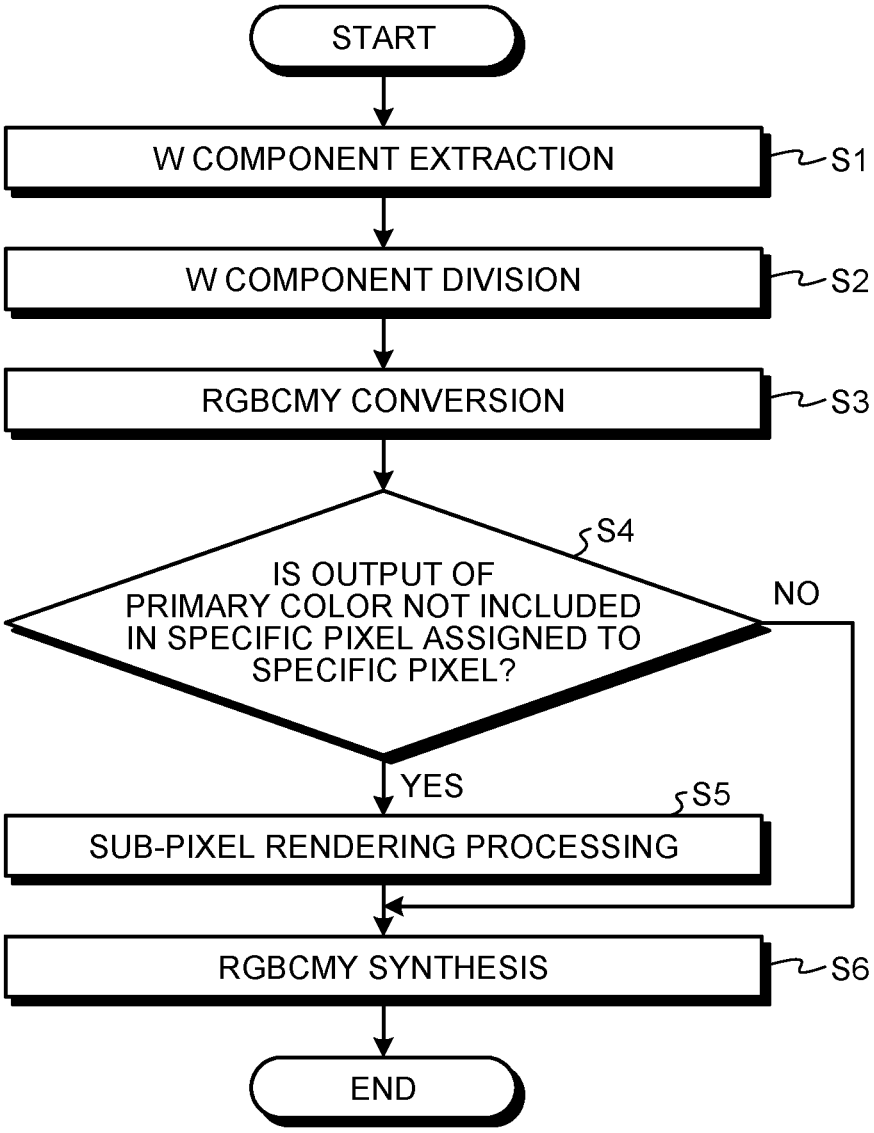
FIG. 21 is a flowchart illustrating an example of a processing procedure for outputting an output signal based on an input signal.

FIG. 21 is a flowchart illustrating an example of a processing procedure for outputting the output signal based on the input signal. The signal processing unit 20 performs W component extraction based on the gradation value indicated by the input signal (Step S1). Next, the signal processing unit 20 performs W component division (Step S2). The signal processing unit 20 also performs RGBCMY conversion (Step S3). The signal processing unit 20 determines whether the output of the primary color not included in a specific pixel 48 among the colors of the sub-pixels required to emit light in accordance with the color component other than the white component is assigned to the specific pixel 48 (Step S4). If it is determined that the output of the primary color not included in the specific pixel 48 is assigned to the specific pixel 48 (Yes at Step S4), the signal processing unit 20 assigns the color component of the primary color to another pixel 48 including the sub-pixel 49 of the primary color through sub-pixel rendering processing (Step S5). If it is determined that the output of the primary color not included in the specific pixel 48 is not assigned to the specific pixel 48 at Step S4 (No at Step S4), the process at Step S5 is not performed. The process at Step S2 and the processes at Step S3 to Step S5 may be performed in random order, or may be performed in parallel. After these processes, the signal processing unit 20 obtains the gradation value synthesized through RGBCMY synthesis to obtain the output signal indicating the obtained gradation value (Step S6).

In the description with reference to FIG. 18 and FIG. 19, the signal processing unit 20 first performs W component extraction. Alternatively, the signal processing unit 20 may employ one of W component extraction and CMY component extraction for each pixel 48 so that each pixel 48 can perform output without performing sub-pixel rendering processing. The following describes a case of employing CMY component extraction with reference to FIG. 20.

FIG. 20 is an explanatory diagram illustrating an example of processing performed by the signal processing unit 20. With reference to FIG. 20, described is an example in which the input signal of (R, G, B)=(127, 127, 254) is input for each of the three pixels 48A, 48B, and 48C. In the description with reference to FIG. 20, CMY component extraction is described exemplifying the pixel 48A in which CMY component extraction is employed.

The gradation value indicated by the input signal of (R, G, B)=(127, 127, 254) can be converted into (R, G, B, C, M, Y)=(0, 0, 0, 127, 127, 0). In this case, the pixel 48A can output cyan (C) and magenta (M) using the fourth sub-pixel 49C and the fifth sub-pixel 49M without performing sub-pixel rendering processing. Thus, when CMY component extraction is employed, the pixel 48A can perform output corresponding to the input signal without performing sub-pixel rendering processing. In contrast, when the W component extraction described above with reference to FIGS. 18 and 19 is performed on the input signal of (R, G, B)=(127, 127, 254), the component of the third primary color that cannot be output with the pixel 48A, that is, the component of (R, G, B)=(0, 0, 127) is generated. Due to this, when W component extraction is employed, part of the component indicated by the input signal for the pixel 48A is assigned to another pixel 48 through sub-pixel rendering processing. Thus, in the example illustrated in FIG. 20, the signal processing unit 20 employs CMY component extraction for the output of the pixel 48A.

When W component extraction is performed, the pixels 48B and 48C can output the component of (R, G, B)=(0, 0, 127) remaining as the component other than the W component without performing sub-pixel rendering processing. The pixel 48B cannot output magenta (M). The pixel 48C cannot output cyan (C). Thus, in the example illustrated in FIG. 20, the signal processing unit 20 employs W component extraction in accordance with the outputs of the pixels 48B and 48C.

The signal processing unit 20 performs processing for extracting the white component (Wout) from the input signal to separate the input signal into the white component and the color component other than the white component (W component extraction). Specifically, the input signal of (R, G, B)=(127, 127, 254) illustrated in FIG. 18 can be separated into the white component of (R, G, B)=(127, 127, 127) and the color component of (R, G, B)=(0, 0, 127), which is the color component other than the white component.

The signal processing unit 20 performs processing for dividing the color component (W component division) to output the white component by combining the colors of the sub-pixels 49 included in each pixel 48. Specifically, the signal processing unit 20 divides the white components in the pixels 48B and 48C into (R, G, B, C, M, Y)=(64, 0, 64, 63, 0, 63) and (0, 64, 64, 0, 63, 63), respectively. The color component of (R, G, B)=(0, 0, 127) as the color component other than the white component is assigned to the third sub-pixel 49B to synthesize the color component of (R, G, B)=(0, 0, 127) with the color component of (R, G, B, C, M, Y) indicated by a result of W component division. Specifically, the signal processing unit 20 obtains signals indicating the gradation values of (R, G, B, C, M, Y)=(64, 0, 191, 63, 0, 63) and (0, 64, 191, 0, 63, 63) as the output signals for the pixels 48B and 48C.

In the example illustrated in FIG. 19, the color component of (R, G, B)=(0, 0, 64) in the pixel 48A is separated into two parts to be assigned to the pixels 48B and 48C. However, this is merely an example of assignment of the gradation value in sub-pixel rendering processing, and the embodiment is not limited thereto. In sub-pixel rendering processing, the pixel 48 to be assigned the gradation value and the extent to which the gradation value is assigned thereto can be appropriately changed. Accordingly, for example, a ratio between the primary color and the complementary color (64:63) in W component division of the pixels 48B and 48C in FIG. 20 may be reversed, that is, the ratio can be freely changed in an appropriate range as a result of division of the original white component of (R, G, B)=(127, 127, 127). The display device 10 according to the present embodiment has a maximum light emitting capability for performing output (light emission) of the sub-pixel 49 in the pixel 48 in accordance with the gradation value assigned from another pixel 48 through sub-pixel rendering processing, and is provided through a designing process and a manufacturing process considering such a maximum light emitting capability.

The light emitting capability of each sub-pixel 49 included in the display device 10 according to the present embodiment is higher than the light emitting capability required for a color gamut of the display device 10 reproduced by combining the colors of the sub-pixels 49. The following describes such a light emitting capability with reference to FIG. 22.

Figure 22:
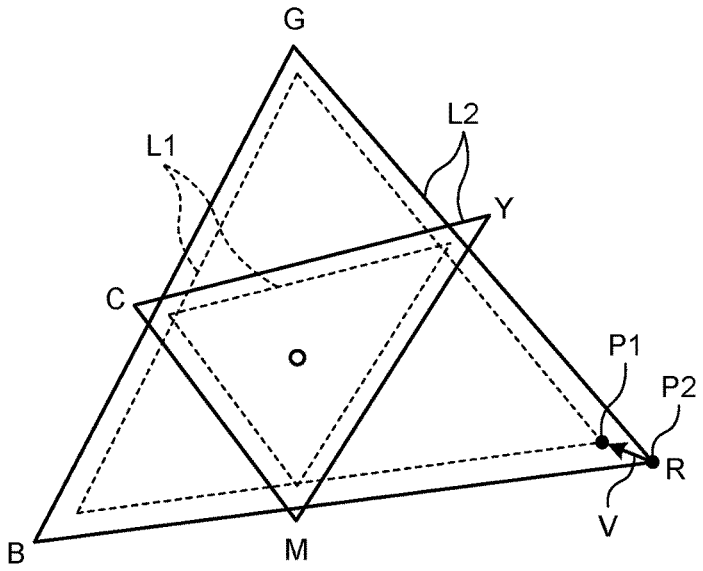
FIG. 22 is a schematic diagram illustrating a relation between a color gamut that can be reproduced with a light emitting capability of each sub-pixel included in the display device and a color gamut of the display device that is actually output by combining the colors of the sub-pixels.

FIG. 22 is a schematic diagram illustrating a relation between the color gamut that can be reproduced with the light emitting capability of each sub-pixel 49 included in the display device 10 and the color gamut of the display device 10 that is actually output by combining the colors of the sub-pixels 49. Suppose that the color gamut that can be reproduced with the light emitting capability of each sub-pixel 49 included in the display device 10 and the color gamut of the display device 10 that is actually output by combining the colors of the sub-pixels 49 are the same color gamut L1, that is, suppose that a maximum color gamut based on potential of the light emitting capability of the sub-pixel 49 of the display device 10 is the same as an effective color gamut that can be visually recognized in the display output performed by the display device 10. In outputting one primary color having a maximum gradation value, the display device 10 causes the sub-pixel 49 of the primary color to be lit with a maximum light emitting capability. In other words, under the above hypothetical condition, the display device 10 cannot cause the sub-pixel 49 of another color to be lit in outputting one primary color having the maximum gradation value. This is because, if the sub-pixel 49 of another color is lit, a reproduced color of the display device 10 is shifted toward the lit color, and an output as the primary color cannot be obtained. For example, if the sub-pixel 49 of another color is lit when red (R) is to be output with the maximum gradation value, the reproduced color is brought close to a color other than red (R) and becomes a color not corresponding to the primary color of red (R). The same applies to the other primary colors. The fact that the sub-pixel 49 of another color cannot be lit in outputting one primary color having the maximum gradation value means that only one sub-pixel (for example, the first sub-pixel 49R) of the six sub-pixels 49 can be lit. Due to this, in a case of the pixel array illustrated in FIG. 3 and the like, a cycle of the sub-pixels 49 emitting light becomes two thirds in the horizontal direction, which may be recognized as granularity.

In contrast, in the present embodiment, as illustrated in FIG. 22, a color gamut (denoted by reference numeral L2) that can be reproduced with the light emitting capability of each sub-pixel included in the display device 10 is larger than the color gamut (denoted by reference numeral L1) of the display device 10 that is actually output by combining the colors of the sub-pixels. Accordingly, the display device 10 according to the present embodiment can cause the sub-pixels 49 of colors other than the primary color to be lit in outputting one primary color having the maximum gradation value. For example, to output red (R) with the maximum gradation value of the "actually output color gamut of the display device 10", a target color corresponds to the reference numeral P1 in the color gamut L1 in FIG. 22. If the other sub-pixels 49 are not lit when the first sub-pixel 49R included in the display device 10 is lit with the maximum light emitting capability, the color to be output corresponds to the reference numeral P2 positioned on an outer side than the reference numeral P1 in the color gamut L1 of FIG. 22. In this case, the color is deviated from the "actually output color gamut of the display device 10". However, by causing the sub-pixel 49 of another color to be lit, a color component of light to be output can be brought close to the "actually output color gamut of the display device 10". For example, by causing both green (G) and blue (B) to be lit, the color can be shifted from the reference numeral P2 toward the reference numeral P1 as represented by the arrow V. The color can be shifted from the reference numeral P2 toward the reference numeral P1 also by causing cyan (C) as the complementary color of red (R) to be lit. The color can be shifted from the reference numeral P2 toward the reference numeral P1 also by causing magenta (M) and yellow (Y) to be lit. The color can be shifted from the reference numeral P2 toward the reference numeral P1 also by causing cyan (C), magenta (M), and yellow (Y) to be lit to output the white (W) component. Two or more lighting patterns as exemplified above for "shifting the color from P2 toward the reference numeral P1" can be combined. A case of reproducing the color of red (R) has been described above as an example. Also in a case of outputting another primary color or another complementary color, the sub-pixel of a color other than a "color intended to be reproduced" can be lit. That is, with the display device 10 according to the present embodiment, when the light emitting capability of each sub-pixel 49 is higher than the light emitting capability required for the color gamut of the display device 10 reproduced by combining the colors of the sub-pixels 49, more sub-pixels 49 can be lit irrespective of the output color. Accordingly, the granularity can be further reduced irrespective of the content of the display output.

As described above, with the display device 10 according to the present embodiment, there are two or more combinations of the sub-pixels 49 for outputting white light for each sub-pixel 49, so that the sub-pixels 49 can be more variously combined for outputting white light. By setting two or more combination patterns of the sub-pixels 49 for outputting white light for each pixel 48, a display output with higher resolution can be performed.

The two sub-pixels 49 that are included in different pixels 48 and adjacent to each other in the first direction (for example, the column direction) are complementary to each other, so that a combination of white light using the sub-pixels 49 of the adjacent pixels 48 can be achieved. Accordingly, the sub-pixels 49 can be more variously combined for outputting white light. A display output with higher resolution can be performed using such a combination.

One pixel includes the sub-pixel 49 of the primary color and the sub-pixel 49 of the complementary color of the primary color, the number of the sub-pixels 49 of both the primary colors and the complementary colors being equal to or larger than 1 and smaller than a predetermined number, so that the resolution based on the number of the pixels 48 (real resolution) can be enhanced as compared with a case in which one pixel 48 includes the sub-pixels 49 of all of the primary colors and the complementary colors.

The display device 10 includes the signal processing unit 20 that assigns the output of the primary color not included in the specific pixel 48 among the colors of the sub-pixels 49 required to emit light in accordance with the input signal to another pixel 48 including the sub-pixel 49 of the primary color, so that an output can be performed in accordance with the gradation value of each color indicated by the input signal using the entire display region.

At least one set of sub-pixels in the pixel 48 is different from the sets of sub-pixels in the pixel 48 to which the former pixel 48 is adjacent in the second direction (for example, the row direction), so that the signal processing unit 20 can easily assign the color to another pixel 48 fairly close to the specific pixel 48. Due to this, the output of the color can be alternatively performed at the coordinates close as much as possible to the coordinates (the position of the pixel 48) of the color indicated by the input signal (another pixel 48 fairly close to the specific pixel 48), so that a relation fairly close to the relation between the color indicated by the input signal and the coordinates can be more easily achieved.

The pixel region including the predetermined number of pixels aligned along the second direction includes the predetermined number of sub-pixels of the primary colors and the same number of sub-pixels of the complementary colors of the primary colors, so that the color can be more easily balanced in the entire display region.

The predetermined number of colors is three, and the first primary color, the second primary color, and the third primary color are red (R), green (G), and blue (B), so that the output corresponding to the input signal as RGB data can be more easily performed.

The light emitting capability of each sub-pixel is higher than the light emitting capability required for the color gamut of the display device 10 reproduced by combining the colors of the sub-pixels, so that the granularity can be further reduced irrespective of the content of the display output.

Figure 23:
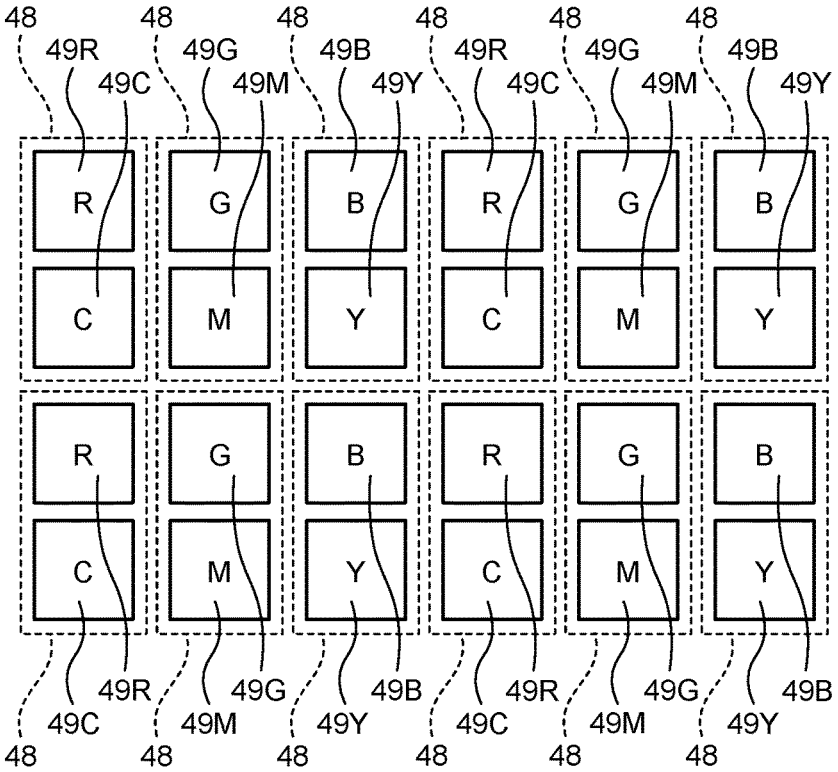
FIG. 23 is a diagram illustrating an example of a case in which the pixel includes one set of sub-pixels.

In the above embodiment, one pixel 48 includes two sets of sub-pixels. However, the number of sets of sub-pixels included in one pixel can be appropriately changed. FIG. 23 is a diagram illustrating an example of a case in which the pixel includes one set of sub-pixels. As illustrated in FIG. 23, a constituent unit of the pixel 48 may be one set of sub-pixels. More specifically, for example, the pixel 48 illustrated in FIG. 23 includes the sub-pixels of the primary color and the complementary color thereof as the constituent unit. In the example illustrated in FIG. 23, the constituent unit of the pixel 48 is 1×2 in the row direction and the column direction while keeping the arrangement of the sub-pixels 49 illustrated in FIG. 3. However, this is merely an example and the embodiment is not limited thereto. The arrangement in the row direction and the column direction may be reversed, or the constituent unit of the pixel 48 may be one set of sub-pixels while keeping the arrangement of the sub-pixels 49 illustrated in FIGS. 13 and 14.

The above embodiment exemplifies the first primary color, the second primary color, the third primary color, and the complementary colors thereof. The number of the primary colors and the primary color of the sub-pixel 49 are freely determined. For example, colors such as orange and indigo blue may be used as the primary colors. To perform what is called a full-color output, the three primary colors of red (R), green (G), and blue (B) described in the above embodiment are preferably employed as the primary colors of the sub-pixels 49.

Figure 24:
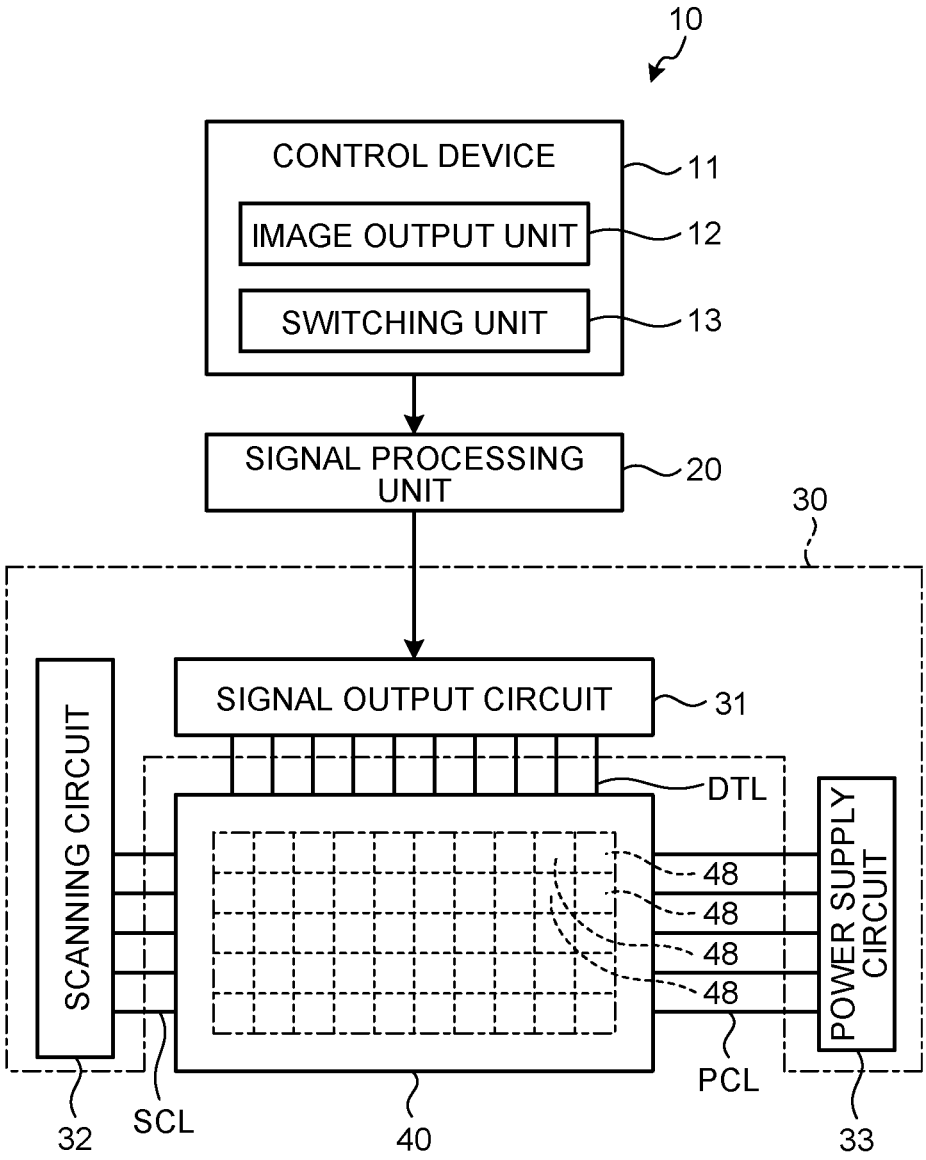
FIG. 24 is a diagram illustrating a configuration example of a display system including the display device and a switching device that switches effective resolution of the display device in accordance with resolution of the input image.

In the display device 10 according to the present invention, the effective resolution can be changed based on a relation between the number of sub-pixels and the resolution of the image input to the display device 10 (hereinafter, referred to as an input image). FIG. 24 is a diagram illustrating a configuration example of a display system including the display device 10 and the control device 11 functioning as a switching device that switches the effective resolution of the display device 10 in accordance with resolution of the input image. The display device 10 is the same as that described above, so that detailed description thereof will not be repeated. Hereinafter, exemplified is a case in which the pixel 48 and the sub-pixel 49 included in the display device 10 have the relation illustrated in FIG. 3.

The control device 11 includes a switching unit 13. The switching unit 13 has a function for switching a setting of the combination of the sub-pixels 49 (minimum unit of the pixel) for outputting white light by combining outputs of adjacent sub-pixels 49 in accordance with the resolution of the input image. Specifically, the switching unit 13 is a circuit having such a function. The display device 10 reproduces contrast of white light using the combination set by the switching unit 13.

For example, when the resolution in the row direction and the column direction of the input image is equal to or smaller than the number of the pixels 48 both in the row direction and the column direction, the switching unit 13 sets the combination to reproduce contrast of white light assuming two sets of sub-pixels included in one pixel 48 as the minimum unit. That is, in this case, the switching unit 13 switches the real resolution to a resolution the number of which is equal to the number of the pixels. When the resolution in the row direction and the column direction of the input image exceeds the number of the pixels 48 in any one of the row direction and the column direction, the switching unit 13 sets the combination to reproduce contrast of white light using one set of sub-pixels as the minimum unit as described above with reference to FIG. 7. That is, in this case, the switching unit 13 causes the real resolution to be two times the number of the pixels 48 similarly to the description with reference to FIG. 10. When the resolution in the row direction and the column direction of the input image exceeds the number of the pixels 48 both in the row direction and the column direction, the switching unit 13 sets the combination to reproduce contrast of white light by combining outputs of the sub-pixels 49 included in different pixels 48 as described above with reference to FIG. 8. That is, in this case, the switching unit 13 causes the real resolution to be four times the number of the pixels 48 similarly to the description with reference to FIG. 11. The control device 11 performs output in accordance with the setting. The signal processing unit 20 of the display device 10 determines the combination of the sub-pixels 49 combined to be used for reproducing contrast of white light in accordance with the output from the control device 11, that is, in accordance with the real resolution set by the switching unit 13 (for example, refer to FIGS. 7, 10, and 11).

In this way, the display system according to the present embodiment switches the effective resolution based on the relation between the number of the sub-pixels 49 and the resolution of the image input to the display device 10, so that the effective resolution more appropriate for the display output of the image can be more easily obtained.

In the present embodiment, a self-luminous type image display panel has been described. Alternatively, the present invention can also be applied to a liquid crystal display device. That is, for example, the present invention can also be applied to a liquid crystal display device including: a display panel including the sub-pixel 49, the color filter 61 that transmits light in a color corresponding to the color of the sub-pixel 49, and a liquid crystal layer; and a lighting device that causes light to be incident on the display panel.

The present invention naturally encompasses other working effects caused by the aspects described in the above embodiment that are obvious from the description herein or that are appropriately conceivable by those skilled in the art.

The present disclosure can also include the following aspects:

(1) A display device comprising a plurality of pixels arranged along a row direction and a column direction, wherein one pixel includes a set of sub-pixels including two sub-pixels that correspond to two colors complementary to each other, the two sub-pixels are arranged adjacent to each other along one of the row direction and the column direction, and two or more combinations of sub-pixels for outputting white light by combining adjacent sub-pixels are present for one sub-pixel.

(2) The display device according to (1), wherein colors of two sub-pixels that are included in different pixels and are adjacent to each other in the one direction are complementary to each other.

(3) The display device according to (1) or (2), wherein a color of each sub-pixel is a color out of colors included in a predetermined number of primary colors and complementary colors of the predetermined number of primary colors, the predetermined number is three or more, and the primary colors include at least a first primary color, a second primary color, and a third primary color, one pixel includes the sub-pixel of the primary color and the sub-pixel of the complementary color of the primary color, and the number of both the primary colors and the complementary colors included in the one pixel is equal to or larger than one and less than the predetermined number.

(4) The display device according to any one of (1) to (3), wherein the combination of light in two colors complementary to each other obtains white light through additive color mixture.

(5) The display device according to (4), further comprising a signal processing unit that assigns an output of a primary color not included in a pixel to at least one other pixel including a sub-pixel of the primary color.

(6) The display device according to (4) or (5), wherein at least one set of sub-pixels in one of two pixels adjacent to each other in the other one of the row direction and the column direction is different from the sets of sub-pixels in the other one of the two pixels.

(7) The display device according to any one of (4) to (6), wherein the predetermined number of sub-pixels of the primary colors and the same number of sub-pixels of the complementary colors of the primary colors are included in a pixel region including the predetermined number of pixels aligned in the other one of the row direction and the column direction.

(8) The display device according to any one of (3) to (7), wherein the first primary color, the second primary color, and the third primary color are red, green, and blue.

(9) The display device according to any one of (1) to (8), wherein a combination of sub-pixels for outputting white light is switched in accordance with resolution of an input image due to an output from a switching device that switches effective resolution based on a relation between the number of the sub-pixels and the resolution of the input image.

What is claimed is:

1. A display device comprising:

a signal processing unit; and a plurality of pixels arranged along a row direction and a column direction, wherein one pixel includes a set of sub-pixels including two sub-pixels that correspond to two colors complementary to each other, a combination of light of the two colors complementary to each other obtains white light through additive color mixture, the two sub-pixels are arranged adjacent to each other along one of the row direction and the column direction, two or more combinations of sub-pixels for outputting white light by combining adjacent sub-pixels are present for one sub-pixel, and the signal processing unit is configured to:

divide an input signal to a first pixel among the pixels into a white component and a non-white component;

determine, when the input signal has the non-white component, whether the non-white component includes an absent-primary component that is a component of a primary color of which a sub-pixel is not included in the first pixel;

assign an output of the absent-primary component to a combination of sub-pixels other than the primary color in the first pixel when the input signal has the absent-primary component and the combination of sub-pixels other than the primary color in the first pixel allows the first pixel to display the absent-primary component; and assign the output of the absent-primary component to at least one pixel other than the first pixel that includes a sub-pixel of the primary color not included in the first pixel when the input signal has the absent-primary component and the combination of sub-pixels other than the primary color in the first pixel does not allow the first pixel to display the absent-primary component.

2. The display device according to claim 1, wherein colors of two sub-pixels that are included in different pixels and are adjacent to each other in the one direction are complementary to each other.

3. The display device according to claim 1, wherein a color of each sub-pixel is a color out of colors included in a predetermined number of primary colors and complementary colors of the primary colors, the predetermined number is three or more, and the primary colors include at least a first primary color, a second primary color, and a third primary color, one pixel includes the sub-pixel of the primary color and the sub-pixel of the complementary color of the primary color, and the number of both the primary colors and the complementary colors included in the one pixel is equal to or larger than one and less than the predetermined number.

4. The display device according to claim 1, wherein at least one set of sub-pixels in one of two pixels adjacent to each other in the other one of the row direction and the column direction is different from the sets of sub-pixels in the other one of the two pixels.

5. The display device according to claim 1, wherein the predetermined number of sub-pixels of the primary colors and the same number of sub-pixels of the complementary colors of the primary colors are included in a pixel region including the predetermined number of pixels aligned in the other one of the row direction and the column direction.

6. The display device according to claim 3, wherein the first primary color, the second primary color, and the third primary color are red, green, and blue.

7. The display device according to claim 1, further comprising a switching device, wherein, the switching device switches effective resolution based on a relation between the number of the sub-pixels and a resolution of the input image, a combination of sub-pixels for outputting white light is switched in accordance with resolution of an input image due to an output from the switching device.

* * * * *